US008500496B2

(12) United States Patent
Bopp et al.

(10) Patent No.: US 8,500,496 B2
(45) Date of Patent: Aug. 6, 2013

(54) ELECTRICAL CONNECTORS HAVING OPEN-ENDED CONDUCTORS

(71) Applicant: Tyco Electronics Corporation, Berwyn, PA (US)

(72) Inventors: Steven Richard Bopp, Jamestown, NC (US); Paul John Pepe, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/646,415

(22) Filed: Oct. 5, 2012

(65) Prior Publication Data

US 2013/0029536 A1 Jan. 31, 2013

Related U.S. Application Data

(63) Continuation of application No. 13/214,760, filed on Aug. 22, 2011, now Pat. No. 8,282,425, which is a continuation of application No. 12/547,245, filed on Aug. 25, 2009, now Pat. No. 8,016,621.

(51) Int. Cl.
*H01R 24/00* (2011.01)

(52) U.S. Cl.
USPC ..... 439/676; 439/941

(58) Field of Classification Search
USPC ..... 439/676, 941, 404, 76.1, 620.23, 439/620.11, 620.22
See application file for complete search history.

(56) References Cited

U.S. PATENT DOCUMENTS

| | | | | |
|---|---|---|---|---|
| 5,299,956 | A | | 4/1994 | Brownell et al. |
| 5,310,363 | A | | 5/1994 | Brownell et al. |
| 5,432,484 | A | | 7/1995 | Klas et al. |
| 5,454,738 | A | | 10/1995 | Lim et al. |
| 5,470,244 | A | | 11/1995 | Lim et al. |
| 5,700,167 | A | | 12/1997 | Pharney et al. |
| 5,967,853 | A | | 10/1999 | Hashim |
| 5,997,358 | A | * | 12/1999 | Adriaenssens et al. ..... 439/676 |
| 6,089,923 | A | | 7/2000 | Phommachanh |

(Continued)

FOREIGN PATENT DOCUMENTS

| | | |
|---|---|---|
| EP | 0901201 | 3/1999 |
| EP | 0940890 | 9/1999 |

(Continued)

OTHER PUBLICATIONS

International Search Report, International Application No. PCT/US2010/002278, International Filing Date Aug, 19, 2010.

(Continued)

*Primary Examiner* — Javaid Nasri

(57) ABSTRACT

An electrical connector including a contact sub-assembly having a plurality of mating conductors that are configured to transmit signal current. Each of the mating conductors extends between an engagement portion and an interior portion of the respective mating conductor. The engagement portions are located proximate to one another at a first nodal region. The interior portions are located proximate to one another at a second nodal region. The electrical connector also includes first open-ended conductors that are electrically connected to the engagement portions of corresponding mating conductors. The electrical connector also includes second open-ended conductors that are electrically connected to the interior portions of corresponding mating conductors. The first open-ended conductors are capacitively coupled to the second open-ended conductors.

20 Claims, 16 Drawing Sheets

U.S. PATENT DOCUMENTS

| | | | |
|---|---|---|---|
| 6,107,578 | A | 8/2000 | Hashim |
| 6,116,964 | A | 9/2000 | Goodrich et al. |
| 6,139,371 | A | 10/2000 | Troutman et al. |
| 6,186,834 | B1 | 2/2001 | Arnett et al. |
| 6,231,397 | B1 | 5/2001 | de la Borbolla et al. |
| 6,270,381 | B1 | 8/2001 | Adriaenssens et al. |
| 6,317,011 | B1 | 11/2001 | Barnett et al. |
| 6,350,158 | B1 | 2/2002 | Arnett et al. |
| 6,443,777 | B1 | 9/2002 | McCurdy et al. |
| 6,464,541 | B1 | 10/2002 | Hashim et al. |
| 6,522,152 | B1 | 2/2003 | Tonti et al. |
| 6,558,207 | B1 | 5/2003 | Pepe et al. |
| 6,840,779 | B2 | 1/2005 | Eberle et al. |
| 6,840,816 | B2 | 1/2005 | Aekins |
| 6,866,548 | B2 | 3/2005 | Hashim |
| 7,025,635 | B2 | 4/2006 | Chang |
| 7,038,554 | B2 | 5/2006 | Seefried |
| 7,074,092 | B1 | 7/2006 | Green et al. |
| 7,140,024 | B2 | 11/2006 | Kaulgud et al. |
| 7,140,924 | B2 | 11/2006 | Redfield et al. |
| 7,153,168 | B2 | 12/2006 | Caveney et al. |
| 7,166,000 | B2 | 1/2007 | Pharney |
| 7,182,649 | B2 | 2/2007 | Caveney et al. |
| 7,190,594 | B2 | 3/2007 | Hashim et al. |
| 7,201,618 | B2 | 4/2007 | Ellis et al. |
| 7,281,957 | B2 | 10/2007 | Caveney |
| 7,294,025 | B1 | 11/2007 | Chen |
| 7,309,261 | B2 | 12/2007 | Caveney et al. |
| 7,314,393 | B2 | 1/2008 | Hashim |
| 7,341,493 | B2 | 3/2008 | Pepe et al. |
| 7,357,683 | B2 | 4/2008 | Caveney et al. |
| 7,364,470 | B2 | 4/2008 | Hashim |
| 7,367,849 | B2 | 5/2008 | Wang et al. |
| 7,381,098 | B2 | 6/2008 | Hammond, Jr. et al. |
| 7,402,085 | B2 | 7/2008 | Hammond, Jr. et al. |
| 7,407,417 | B2 | 8/2008 | Pepe et al. |
| 7,410,367 | B2 | 8/2008 | Hashim et al. |
| 7,442,092 | B2 | 10/2008 | Caveney et al. |
| 7,452,246 | B2 | 11/2008 | Caveney et al. |
| 7,481,678 | B2 | 1/2009 | Aekins |
| 7,481,681 | B2 | 1/2009 | Caveney et al. |
| 7,485,004 | B2 | 2/2009 | Liu et al. |
| 7,544,088 | B2 | 6/2009 | Caveney et al. |
| 7,572,148 | B1 | 8/2009 | Pepe et al. |
| 7,575,482 | B1 | 8/2009 | Pepe et al. |
| 7,628,656 | B2 | 12/2009 | Shields et al. |
| 7,641,521 | B2 | 1/2010 | Pepe et al. |
| 7,658,651 | B2 | 2/2010 | Pepe et al. |
| 7,686,649 | B2 | 3/2010 | Pepe et al. |
| 7,785,154 | B2 | 8/2010 | Peng |
| RE41,699 | E | 9/2010 | Itano et al. |
| 7,794,286 | B2 | 9/2010 | Abu Ghazaleh et al. |
| 7,823,281 | B2 | 11/2010 | Caveney et al. |
| 7,824,231 | B2 | 11/2010 | Marti et al. |
| 7,837,513 | B2 | 11/2010 | Millette et al. |
| 7,857,362 | B2 | 12/2010 | Deblock |
| 7,857,635 | B2 | 12/2010 | Goodrich et al. |
| 7,874,879 | B2 | 1/2011 | Caveney et al. |
| 7,914,345 | B2 | 3/2011 | Bopp et al. |
| 7,927,152 | B2 | 4/2011 | Pepe et al. |
| 7,967,644 | B2 | 6/2011 | Pepe et al. |
| 8,016,621 | B2 | 9/2011 | Bopp et al. |
| 8,128,436 | B2 | 3/2012 | Bopp et al. |
| 8,187,040 | B2 * | 5/2012 | Pepe et al. ..... 439/676 |
| 8,282,425 | B2 | 10/2012 | Bopp et al. |
| 8,287,316 | B2 | 10/2012 | Pepe et al. |
| 2001/0008189 | A1 | 7/2001 | Reede |
| 2001/0014563 | A1 | 8/2001 | Morita et al. |
| 2004/0127105 | A1 | 7/2004 | Itano et al. |
| 2004/0146002 | A1 | 7/2004 | Azadet |
| 2004/0224564 | A1 | 11/2004 | Wan et al. |
| 2005/0026509 | A1 | 2/2005 | Chang |
| 2005/0136747 | A1 | 6/2005 | Caveney et al. |
| 2005/0282442 | A1 | 12/2005 | Hyland et al. |
| 2006/0134992 | A1 | 6/2006 | Green et al. |
| 2007/0015417 | A1 | 1/2007 | Caveney et al. |
| 2007/0117469 | A1 | 5/2007 | Caveney et al. |
| 2007/0123112 | A1 | 5/2007 | Caveney et al. |
| 2007/0212945 | A1 | 9/2007 | Wang et al. |
| 2007/0212946 | A1 | 9/2007 | Bert et al. |
| 2007/0254529 | A1 | 11/2007 | Pepe et al. |
| 2007/0259571 | A1 | 11/2007 | Chen |
| 2007/0293094 | A1 | 12/2007 | Aekins |
| 2008/0045090 | A1 | 2/2008 | Caveney |
| 2008/0171454 | A1 | 7/2008 | Liu et al. |
| 2008/0239937 | A1 | 10/2008 | Erickson et al. |
| 2008/0268710 | A1 | 10/2008 | Hashim et al. |
| 2008/0305680 | A1 | 12/2008 | Little et al. |
| 2008/0305692 | A1 | 12/2008 | Little et al. |
| 2008/0311778 | A1 | 12/2008 | Aekins |
| 2009/0075523 | A1 | 3/2009 | Caveney et al. |
| 2009/0104821 | A1 | 4/2009 | Marti et al. |
| 2009/0258545 | A1 | 10/2009 | Pepe et al. |
| 2009/0269978 | A1 | 10/2009 | Pepe et al. |
| 2009/0305563 | A1 | 12/2009 | Pepe et al. |
| 2009/0318033 | A1 | 12/2009 | Tobey |
| 2010/0041278 | A1 | 2/2010 | Bopp et al. |
| 2010/0221956 | A1 | 9/2010 | Pepe et al. |
| 2011/0053428 | A1 | 3/2011 | Pepe et al. |
| 2011/0053430 | A1 | 3/2011 | Bopp et al. |
| 2011/0053431 | A1 | 3/2011 | Bopp et al. |
| 2011/0143605 | A1 | 6/2011 | Pepe |
| 2011/0171858 | A1 | 7/2011 | Pepe et al. |
| 2011/0250802 | A1 | 10/2011 | Pepe et al. |
| 2011/0306250 | A1 | 12/2011 | Bopp et al. |
| 2012/0034822 | A1 | 2/2012 | Bopp et al. |

FOREIGN PATENT DOCUMENTS

| | | |
|---|---|---|
| EP | 1406354 | 4/2004 |
| EP | 1596478 | 5/2005 |
| GB | 2438746 | 6/2007 |
| WO | WO2007/009020 | 1/2007 |
| WO | WO2009/131640 | 10/2009 |

OTHER PUBLICATIONS

Annex to Form PCT/ISA/206, Communication Relating to the Results of the Partial International Search Report, Int'l Appln. Number PCT/2010/002279, Int'l Filing Date Aug. 19, 2010.

International Search Report, International Search Report No. PCT/US2010/002285, International Filing Date Aug. 19, 2010.

* cited by examiner 140
204
208
202
206
$T_{P1}$
$S_1$
$S_2$
$S_3$
$S_4$
$S_5$
$S_6$
$L_{PC1}$
$W_{PC1}$
+2
-1
+4
-5
+6
-7
+8
-3
+2
-1
+4
-5
+6
-7
+8
-3
+6
-7
+8
-5
+4
-3
+2
-1
+8
-7
+6
-5
+4
-3
+2
-1
+2
-1
-3
-5
+4
+6
-7
+8
-7
+8

ELECTRICAL CONNECTORS HAVING OPEN-ENDED CONDUCTORS

CROSS-REFERENCE TO RELATED APPLICATIONS

The present application is a continuation of U.S. patent application Ser. No. 13/214,760 (U.S. Pat. No. 8,282,425), filed on Aug. 22, 2011, which is a continuation of U.S. patent application Ser. No. 12/547,245 (U.S. Pat. No. 8,016,621), filed on Aug. 25, 2009. Each of the above applications is incorporated by reference in its entirety.

The subject matter described herein is similar to subject matter described in U.S. Pat. No. 7,967,644, entitled "ELECTRICAL CONNECTOR WITH SEPARABLE CONTACTS," and in U.S. Pat. No. 8,128,436, entitled "ELECTRICAL CONNECTORS WITH CROSSTALK COMPENSATION," each of which is incorporated by reference in its entirety.

BACKGROUND OF THE INVENTION

The subject matter herein relates generally to electrical connectors, and more particularly, to electrical connectors that utilize differential pairs and experience offending crosstalk and/or return loss.

The electrical connectors that are commonly used in telecommunication systems, such as modular jacks and modular plugs, may provide interfaces between successive runs of cable in such systems and between cables and electronic devices. The electrical connectors may include contacts that are arranged according to known industry standards, such as Electronics Industries Alliance/Telecommunications Industry Association ("EIA/TIA")-568. However, the performance of the electrical connectors may be negatively affected by, for example, near-end crosstalk (NEXT) loss and/or return loss. Accordingly, in order to improve the performance of the connectors, techniques are used to provide compensation for the NEXT loss and/or to improve the return loss. Such known techniques have focused on arranging the contacts with respect to each other within the electrical connector and/or introducing components to provide the compensation, e.g., compensating NEXT. For example, the compensating signals may be created by crossing the conductors such that a coupling polarity between the two conductors is reversed or the compensating signals may be created by using discrete components.

One known technique is described in U.S. Pat. No. 5,997,358 ("the '358 patent"). The patent discloses an electrical connector that introduces predetermined amounts of compensation between two pairs of conductors that extend from input terminals to output terminals along an interconnection path. Electrical signals on one pair of conductors are coupled onto the other pair of conductors in two or more compensation stages that are time delayed with respect to each other. However, the techniques described in the '358 patent have limited capabilities for providing crosstalk compensation and/or improving return loss.

Thus, there is a need for additional techniques to improve the electrical performance of the electrical connector by reducing crosstalk and/or by improving return loss.

BRIEF DESCRIPTION OF THE INVENTION

In one embodiment, an electrical connector is provided that includes a connector body that is configured to mate with a plug connector and a contact sub-assembly that is held by the connector body. The contact sub-assembly includes a plurality of mating conductors that are configured to transmit signal current along an interconnection path. The contact sub-assembly also includes a plurality of open-ended conductors. Each of the open-ended conductors is electrically connected to a corresponding mating conductor of the plurality of mating conductors. The open-ended conductors are configured to capacitively couple select mating conductors thereby providing a compensation region that is electrically parallel to the interconnection path.

In another embodiment, an electrical connector is provided that includes a connector body configured to mate with a plug connector and a contact sub-assembly held by the connector body. The contact sub-assembly includes a plurality of mating conductors. Each mating conductor extends between an engagement portion and an interior portion and is configured to have a signal current flow therebetween. The contact sub-assembly also includes a plurality of open-ended conductors that are electrically connected to corresponding mating conductors of the plurality of mating conductors. The open-ended conductors capacitively couple the engagement portion of a first mating conductor to the interior portion of a different second mating conductor.

In another embodiment, an electrical connector is provided that includes a connector body configured to mate with a plug connector and a contact sub-assembly held by the connector body. The contact sub-assembly includes a plurality of mating conductors. Each mating conductor extends between an engagement portion and an interior portion and is configured to have a signal current flow therebetween. The contact sub-assembly also includes a plurality of open-ended conductors that are electrically connected to corresponding mating conductors of the plurality of mating conductors. At least two of the open-ended conductors capacitively couple the engagement portion and the interior portion of a common mating conductor.

DETAILED DESCRIPTION OF THE INVENTION

Figure 1:
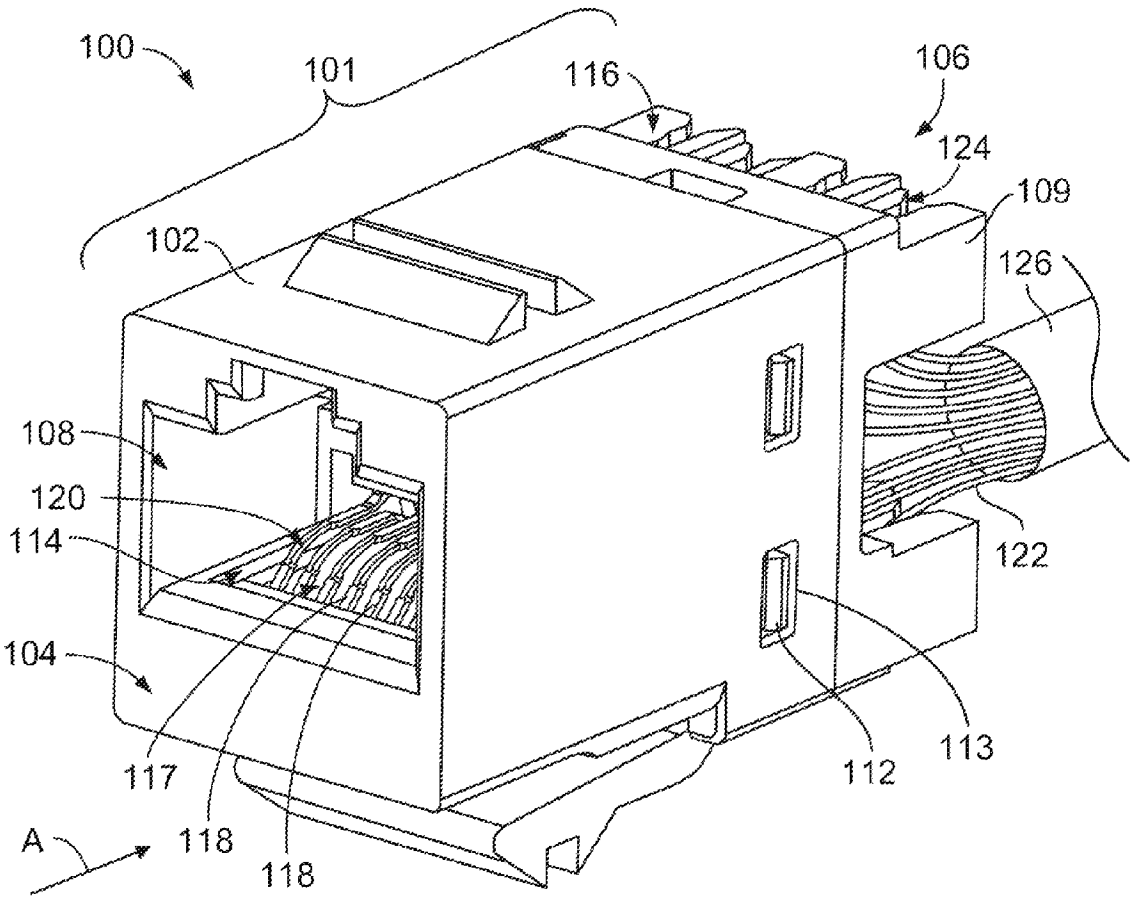
FIG. 1 is perspective view of an exemplary embodiment of an electrical connector.

FIG. 1 is perspective view of an exemplary embodiment of an electrical connector 100. In the exemplary embodiment, the connector 100 is a modular connector, such as, but not limited to, an RJ-45 outlet or communication jack. However, the subject matter described and/or illustrated herein is applicable to other types of electrical connectors. The connector 100 is configured to receive and engage a mating plug, such as a modular plug 145 (shown in FIG. 6) (also referred to as a mating connector). The modular plug 145 is loaded along a mating direction, shown generally by arrow A. The connector 100 includes a connector body 101 having a mating end 104 that is configured to receive and engage the modular plug 145 and a loading end 106 that is configured to electrically and mechanically engage a cable 126. The connector body 101 may include a housing 102 extending from the mating end 104 and toward the loading end 106. The housing 102 may at least partially define an interior chamber 108 that extends therebetween and is configured to receive the modular plug 145 proximate the mating end 104.

The connector 100 includes a wire manager 109 and a contact sub-assembly 110 (shown in FIG. 2) operatively connected to the wire manager 109. The contact sub-assembly 110 is received within the housing 102 proximate to the loading end 106. In the exemplary embodiment, the contact sub-assembly 110 is secured to the housing 102 via tabs 112 that cooperate with corresponding openings 113 within the housing 102. The contact sub-assembly 110 extends from a mating end portion 114 to a terminating end portion 116. The contact sub-assembly 110 is held within the housing 102 such that the mating end portion 114 of the contact sub-assembly 110 is positioned proximate the mating end 104 of the housing 102. The terminating end portion 116 in the exemplary embodiment is located proximate to the loading end 106 of the housing 102. As shown, the contact sub-assembly 110 includes an array 117 of mating conductors or contacts 118. Each mating conductor 118 within the array 117 includes a mating interface 120 arranged within the chamber 108. Each mating interface 120 engages (i.e., interfaces with) a corresponding mating or plug contact 146 (shown in FIG. 6) of the modular plug 145 when the modular plug 145 is mated with the connector 100.

In some embodiments, the arrangement of the mating conductors 118 may be at least partially determined by industry standards, such as, but not limited to, International Electrotechnical Commission (IEC) 60603-7 or Electronics Industries Alliance/Telecommunications Industry Association (EIA/TIA)-568. In an exemplary embodiment, the connector 100 includes eight mating conductors 118 arranged as differential pairs. However, the connector 100 may include any number of mating conductors 118, whether or not the mating conductors 118 are arranged in differential pairs.

In the exemplary embodiment, a plurality of communication wires 122 are attached to terminating portions 124 of the contact sub-assembly 110. The terminating portions 124 are located at the terminating end portion 116 of the contact sub-assembly 110. Each terminating portion 124 may be electrically connected to a corresponding one of the mating conductors 118. The wires 122 extend from a cable 126 and are terminated at the terminating portions 124. Optionally, the terminating portions 124 include insulation displacement connections (IDCs) for electrically connecting the wires 122 to the contact sub-assembly 110. Alternatively, the wires 122 may be terminated to the contact sub-assembly 110 via a soldered connection, a crimped connection, and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the mating conductors 118. Accordingly, the connector 100 may provide electrical signal, electrical ground, and/or electrical power paths between the modular plug 145 and the wires 122 via the mating conductors 118 and the terminating portions 124.

Figure 2:
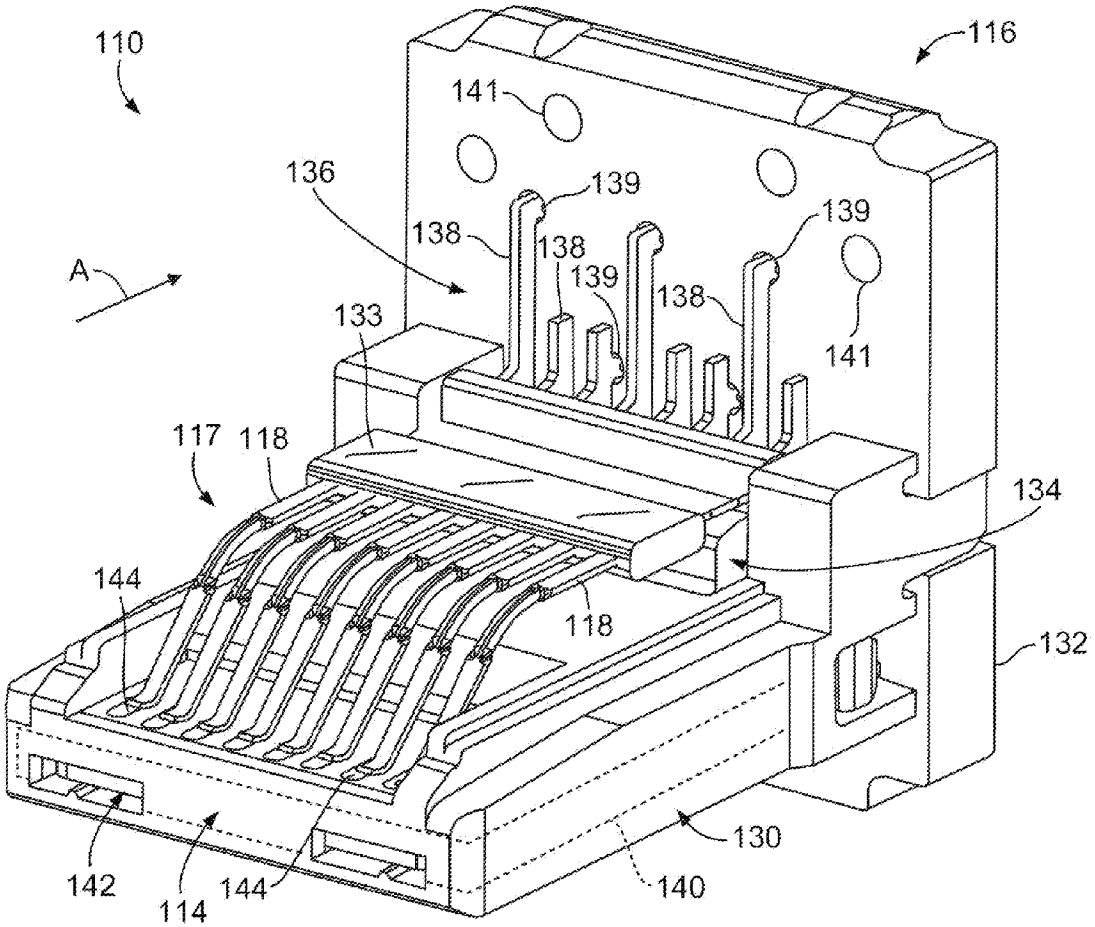
FIG. 2 is a perspective view of an exemplary embodiment of a contact sub-assembly of the electrical connector shown in FIG. 1.
Figure 6:
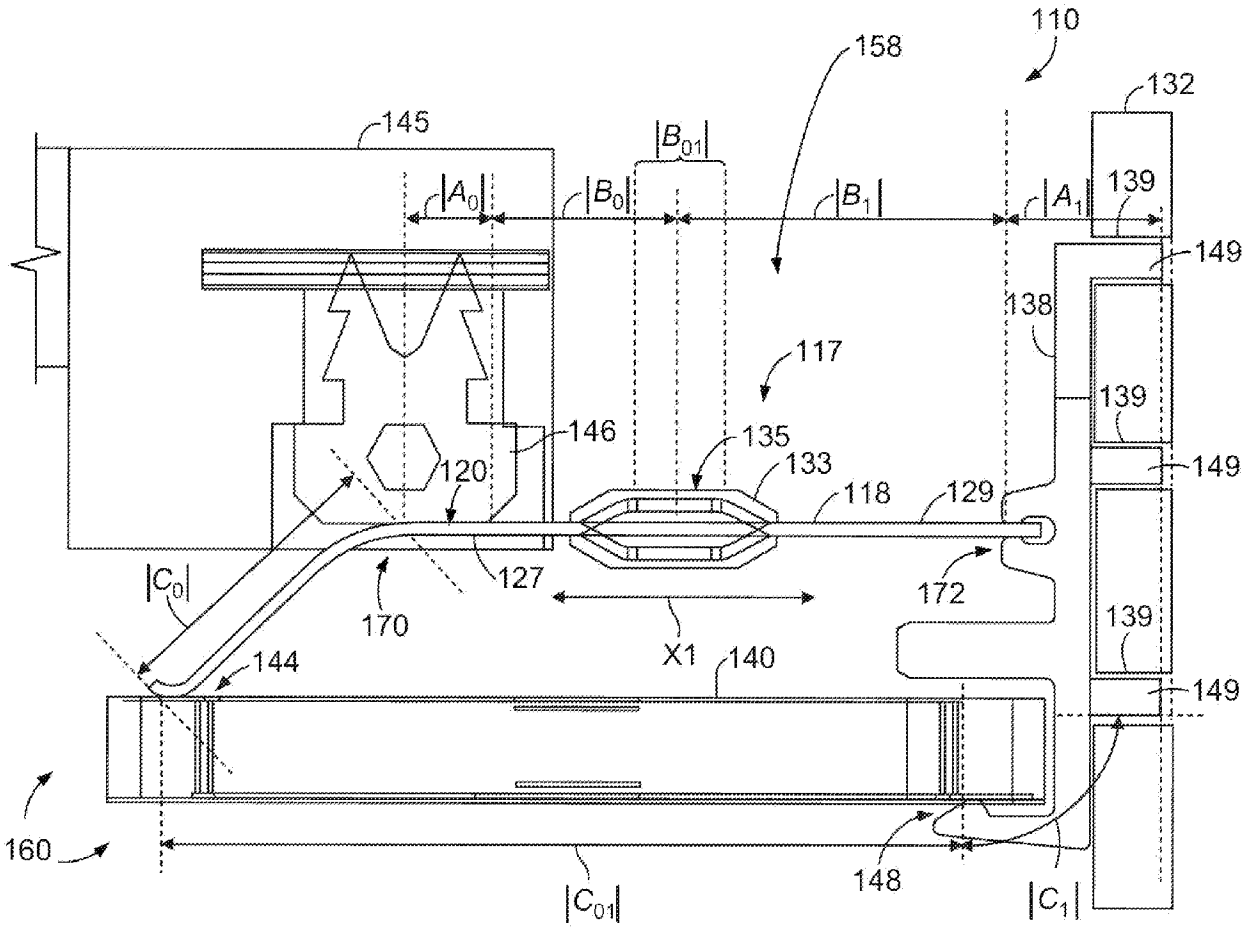
FIG. 6 is a schematic side view of a portion of the contact sub-assembly shown in FIG. 2 when the electrical connector engages a modular plug.

FIG. 2 is a perspective view of an exemplary embodiment of the contact sub-assembly 110. The contact sub-assembly 110 includes a base 130 extending from the mating end portion 114 to a printed circuit 132 proximate the terminating end portion 116, which is located proximate to the loading end 106 (FIG. 1) when the connector 100 (FIG. 1) is fully assembled. As used herein, the term "printed circuit" includes any electric circuit in which conductive pathways have been printed or otherwise deposited in predetermined patterns on a dielectric substrate. For example, the printed circuit 132 may be a circuit board or a flex circuit. The contact sub-assembly 110 may support the array 117 of mating conductors 118 such that the mating conductors 118 extend in a direction that is generally parallel to the loading direction (shown in FIG. 1 by arrow A) of the modular plug 145 (FIG. 6). However, in alternative embodiments, the mating conductors 118 may not extend parallel to the loading direction. Optionally, the base 130 includes a supporting block 134 positioned proximate to the printed circuit 132 and a band 133 of dielectric material that is configured to support the mating conductors 118 in a predetermined arrangement.

Also shown, the contact sub-assembly 110 includes an array 136 of circuit contacts 138. The circuit contacts 138 electrically connect the mating conductors 118 to the printed circuit 132. In the illustrated embodiment, each circuit contact 138 is separably engaged with and electrically connected to a corresponding one of the mating conductors 118. More specifically, the array 136 of circuit contacts 138 may be discrete from the array of mating conductors 118. As used herein, the term "discrete" is intended to mean constituting a separate part or component. The circuit contacts 138 may also be configured to provide compensation for the connector 100 and are described in greater detail in U.S. Pat. No. 7,967,644, which is incorporated by reference in the entirety. However, in other embodiments, the circuit contacts 138 are not discrete, but may form a portion of the mating conductors 118. Furthermore, in alternative embodiments, the contact sub-assembly 110 may not use circuit contacts. For example, the mating conductors 118 may be formed similar to a leadframe and directly engage the printed circuit 132.

Also shown, the printed circuit 132 may engage the circuit contacts 138 through corresponding plated thru-holes or conductor vias 139, which may be electrically connected with plated thru-holes or terminal vias 141. The terminal vias 141, in turn, may be electrically connected to the wires 122 (FIG. 1) proximate the loading end 106. The arrangement or pattern of the conductor vias 139 with respect to each other and to the terminal vias 141 within the printed circuit 132 may be configured for a desired electrical performance. Furthermore, traces (not shown) that electrically connect the terminal vias 141 and conductor 139 and other electrical components (not shown) within the printed circuit 132 may also be configured to tune or obtain a desired electrical performance of the connector 100. Possible arrangements of the conductor and terminal vias 139 and 141 are described in greater detail in U.S. Pat. No. 8,128,436, which is incorporated by reference in the entirety.

The contact sub-assembly 110 may also include a compensation component 140 (indicated by dashed-lines) that extends between the mating end 104 (FIG. 1) (or mating end portion 114) and the loading end 106 (FIG. 1). The compensation component 140 may be received within a cavity 142 of the base 130. The cavity 142 extends from the mating end 104 toward the loading end 106 within the base 130 as indicated by the dashed-lines showing the location of the compensation component 140. The mating conductors 118 may be electrically connected to the compensation component 140 proximate to the mating end 104 and/or the loading end 106. For example, the mating conductors 118 may be electrically connected to the compensation component 140 through contact pads 144, and the mating conductors 118 may also be electrically connected to the circuit contacts 138. The circuit contacts 138 electrically interconnect the mating conductors 118, the traces or conductive pathways of the compensation component 140, and the printed circuit 132.

As will be described in greater detail below, the compensation component 140 may include a compensation region that is formed from, for example, an array of open-ended conductors (e.g., traces) that generate compensating signals for canceling or reducing the offending crosstalk. In some embodiments, another compensation region may be created by the array 117 of mating conductors 118 that is electrically parallel to the compensation region of the compensation component 140. For example, the array 117 of mating conductors 118 and the array of open-ended conductors 118 may be electrically connected to each other proximate to the mating end 104 and also proximate to the loading end 106. However, in alternative embodiments, the array 117 of mating conductors 118 does not include or form a separate compensation region of the connector 100.

Figure 3:
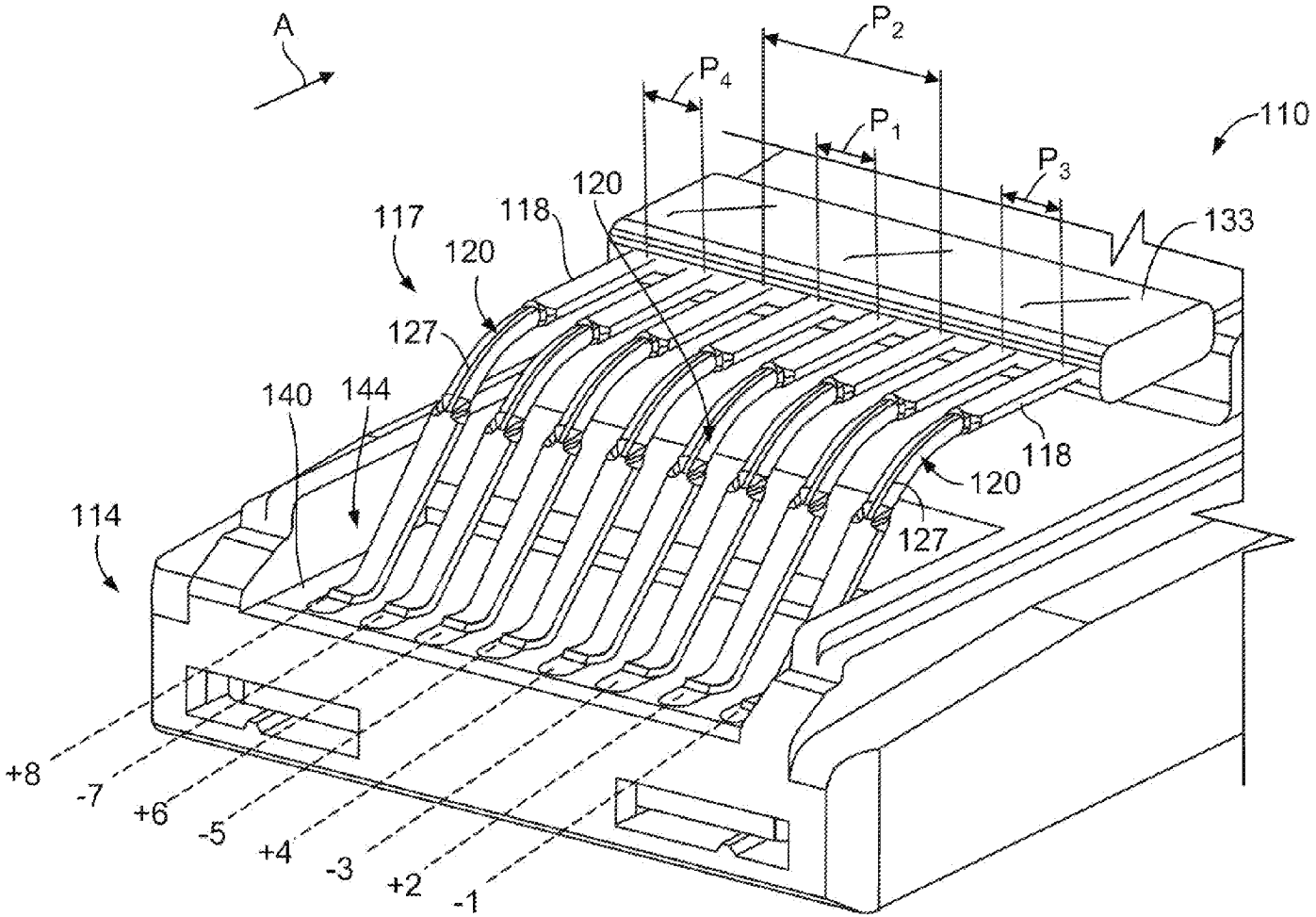
FIG. 3 is an enlarged perspective view of a mating end of the contact sub-assembly shown in FIG. 2.

FIG. 3 is an enlarged perspective view of mating end portion 114 of the contact sub-assembly 110. By way of example, the array 117 may include eight mating conductors 118 that are arranged as a plurality of differential pairs P1-P4. Each differential pair P1-P4 consists of two associated mating conductors 118 in which one mating conductor 118 transmits a signal current and the other mating conductor 118 transmits a signal current that is about 180° out of phase with the associated mating conductor. By convention, the differential pair P1 includes mating conductors +4 and −5; the differential pair P2 includes mating conductors +6 and −3; the differential pair P3 includes mating conductors +2 and −1; and the differential pair P4 includes mating conductors +8 and −7. As used herein, the (+) and (−) represent polarity of the mating conductors. Accordingly, a mating conductor labeled (+) is opposite in polarity to a mating conductor labeled (−), and, as such, the mating conductor labeled (−) carries a signal that is about 180° out of phase with the mating conductor labeled (+). Furthermore, as shown in FIG. 3, the mating conductors +6 and −3 of the differential pair P2 are separated by the mating conductors +4 and −5 that form the differential pair P1. As such, near-end crosstalk (NEXT) may develop between the conductors of differential pair P1 and the conductors of differential pair P2.

Furthermore, each mating conductor 118 may extend along the mating direction A between an engagement portion 127 and an interior portion 129 (shown in FIG. 6). The engagement and interior portions 127 and 129 are separated by a length of the corresponding mating conductor 118. A band 133 and/or a transition region (discussed below) may be located between the engagement and interior portions 127 and 129. The engagement portion 127 is configured to interface with the corresponding plug contact 146 along the mating interface 120, and the interior portion 129 is configured to be electrically connected with circuit contacts 138 proximate to the loading end 106.

When the electrical connector 100 (FIG. 1) is assembled, the mating interfaces 120 are arranged within the chamber 108 (FIG. 1) to engage the corresponding plug contacts 146 (FIG. 6) of the modular plug 145 (FIG. 6). The mating conductors 118 may rest on contact pads 144 such that the mating conductors 118 are electrically connected to the contact pads 144 whether or not the plug contacts 146 are engaging the engagement portions 127. Alternatively, the mating conductors 118 may bend or flex onto corresponding contact pads 144 of the compensation component 140 to make an electrical connection when the plug contacts 146 engage the engagement portions 127. In another embodiment, the mating conductors 118 may be directly engaged with the compensation component 140 (e.g., the mating conductors 118 are inserted into corresponding plated thru-holes or vias).

In alternative embodiments, the array 117 of conductors 118 may have other wiring configurations. For example, the array 117 may be configured under the EIA/TIA-568B modular jack wiring configuration. Accordingly, the illustrated configuration of the array 117 is not intended to be limiting and other configurations may be used.

Figure 4:
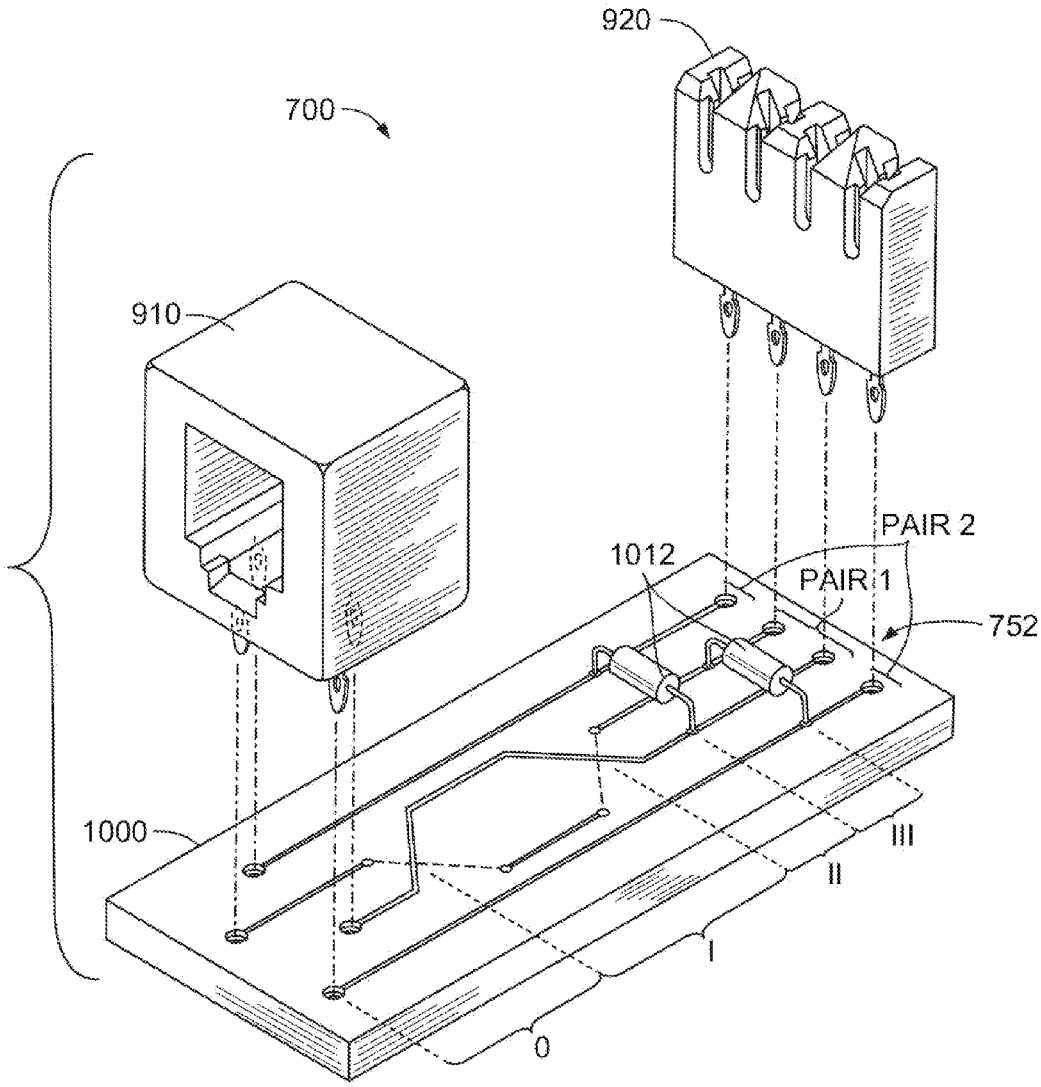
FIG. 4 (Prior Art)
FIG. 4 is an exploded perspective view of a prior art connecter that includes multiple stages for providing compensation.
Figure 5:
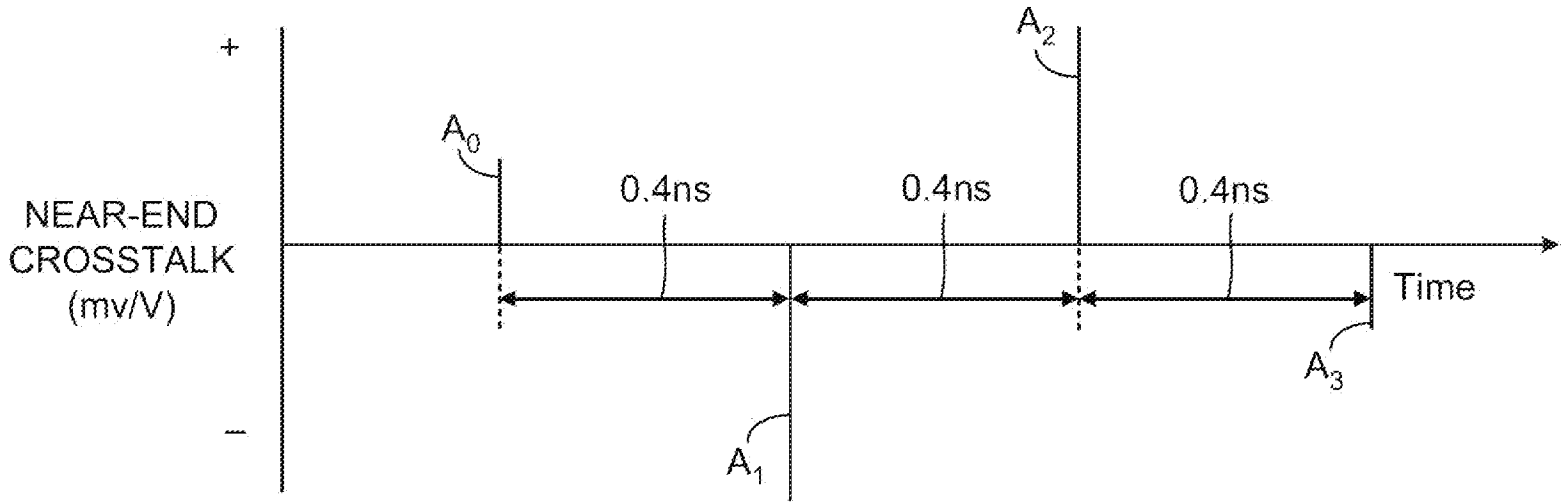
FIG. 5 (Prior Art)
FIG. 5 illustrates polarity and magnitude for the stages shown in FIG. 4 as a function of transmission time delay.

FIG. 4 is an exploded perspective view of a high frequency electrical connector having time-delayed crosstalk compensation as described in U.S. Pat. No. 5,997,358 (the '358 patent). FIG. 5 shows the magnitude and polarity of crosstalk as a function of transmission time delay in a three-stage compensation scheme according to the '358 patent. FIG. 4 includes crossover technology combined with discrete component technology to introduce multiple stages of compensating crosstalk. In Section 0, offending crosstalk comes from closely spaced wires within a modular plug (not shown), modular jack 910, and conductors on board 1000. This offending crosstalk is substantially canceled in magnitude and phase at a given frequency by compensating crosstalk from Sections In Section I, crossover technology is illustratively used to introduce compensating crosstalk that is almost 180 degrees out of phase with the offending crosstalk. In Section II, crossover technology is used again to introduce compensating crosstalk that is almost 180 degrees out of phase with the crosstalk introduced in Section I. And in Section III, additional compensating crosstalk is introduced via discrete components 1012 whose magnitude and phase at a given frequency are selected to substantially eliminate all NEXT in connecting apparatus 100.

FIG. 5 is a vector diagram of crosstalk in a three-stage compensation scheme. In particular, offending crosstalk vector $A_0$ is substantially canceled by compensating crosstalk vectors $A_1$, $A_2$, $A_3$ whose magnitudes and polarities are generally indicated in FIG. 5. It is noted that the offending crosstalk $A_0$ is primarily attributable to the closely spaced parallel wires within a conventional modular plug (not shown), which is inserted into the electrical connector (not shown). The magnitudes of the vectors $A_0$-$A_3$ are in millivolts (my) of crosstalk per volt of input signal power. The effective separation between stages is designed to be about 0.4 nanoseconds. In one embodiment, a particular selection of vector magnitudes and phases provides a null at about 180 MHz in order to reduce NEXT to a level that is 60 dB below the level of the input signal for all frequencies below 100 MHz.

As is understood by the inventors, in order to effectively reduce the effects of the offending crosstalk, the crosstalk generated in Section 0 should be cancelled by the crosstalk generated in Sections I-III. By selecting the locations of crossovers and discrete components 1012 along the interconnection path and the amount of signal coupling between the conductors, the magnitude and phase of crosstalk vectors $A_0$, $A_1$, $A_2$, and $A_3$ can be selected to reduce the overall crosstalk of the connector 700. However, the techniques described in the '358 patent may have limited capabilities for reducing or cancelling the crosstalk and, as such, other techniques that may improve the electrical performance of connectors are still desired.

As best understood by the inventors, the compensation Sections I-III in FIG. 4 are provided at desired, separate time delay locations along an interconnection path in series with the other compensation stages. In other words, the different compensation stages are associated with different phases and are electrically in series with each other. However, the connector 100 (FIG. 1) utilizes different features for compensating the offending crosstalk. As will be described in greater detail below, the compensation regions in connector 100 are electrically parallel to each other between different nodal regions. In the exemplary embodiment of connector 100, one compensation region has a signal current transmitting therethrough and the other compensation region is dominated by capacitive coupling (i.e., negligible amounts of signal current may flow therethrough at high frequencies). The two compensation regions are electrically parallel with respect to each other and are configured to reduce or effectively cancel the offending crosstalk.

FIG. 6 is a schematic side view of a portion of the contact sub-assembly 110 engaging the modular plug 145. The plug contacts 146 of the modular plug 145 are configured to selectively engage mating conductors 118 of the array 117. When the plug contacts 146 engage the mating conductors 118 at the corresponding mating interfaces 120, offending signals that cause noise/crosstalk may be generated. The offending crosstalk (NEXT loss) is created by adjacent or nearby conductors or contacts through capacitive and inductive coupling which yields the exchange of electromagnetic energy between conductors/contacts. Also shown, the circuit contacts 138 may include legs or projections 149 that engage the conductor vias 139 of the printed circuit 132. The conductor vias 139 are electrically connected to corresponding terminal vias 141 (FIG. 2) through the printed circuit 132. Each terminal via 141 may be electrically connected with a contact such as an insulation displacement contact (IDC) for mechanically engaging and electrically connecting to a corresponding wire 122 (FIG. 1). As such, each via terminal 141 may be electrically coupled to a terminating portion 124 (FIG. 1) for interconnecting the mating conductors 118 to the wires 122.

In the illustrated embodiment, the mating conductors 118 form at least one interconnection path X1 that transmits signal current between the mating end 104 (FIG. 1) and the loading end 106 (FIG. 1). As an example, the interconnection path X1 may extend between the engagement portions 127 of the mating conductors 118 and the interior portions 129. An "interconnection path," as used herein, is collectively formed by mating conductors of a differential pair(s) and/or traces of a differential pair(s) that are configured to transmit a signal current between corresponding input and output terminals or nodes when the electrical connector is in operation. In some embodiments, the signal current may be a broadband frequency signal current. By way of example, each differential pair P1-P4 (FIG. 3) transmits signal current along the interconnection path X1 between the corresponding engagement portion 127 and the corresponding interior portion 129. The interconnection path X1 may form a first compensation region 158.

In some embodiments, techniques may be used along the interconnection path X1 to provide compensation for the connector 100. For example, the polarity of crosstalk coupling between the mating conductors 118 may be reversed and/or discrete components may be used along the interconnection path X1. By way of an example, the mating conductors 118 may be crossed over each other at a transition region 135. In other embodiments, non-ohmic plates and discrete components, such as, resistors, capacitors, and/or inductors may be used along interconnection paths for providing compensation. Also, the interconnection path X1 may include one or more NEXT stages. A "NEXT stage," as used herein, is a region where signal coupling (i.e., crosstalk coupling) exists between conductors or pairs of conductors and where the magnitude and phase of the crosstalk are substantially similar, without abrupt change. The NEXT stage could be a NEXT loss stage, where offending signals are generated, or a NEXT compensation stage, where NEXT compensation is provided.

However, in other embodiments, the interconnection path X1 does not include or use any techniques for generating compensating signals. For example, the arrangement of the mating conductors 118 with respect to each other may remain the same as the array 117 extends to the printed circuit 132.

In addition to the interconnection path X1, the compensation component 140 may include at least a portion of a compensation region 160. In the illustrated embodiment, the compensation component 140 is a printed circuit and, more specifically, a circuit board. As shown, the mating conductors 118 may be electrically connected to corresponding contact pads 144 and the circuit contacts 138 may be electrically connected to contact pads 148. The compensation region 160 provides open capacitive NEXT compensation between two ends of the interconnection path X1 (or the compensation region 158).

As shown, the compensation regions 158 and 160 are electrically parallel with respect to each other and, thus, do not provide a substantial time delay relative to each other as in known connectors. In the exemplary embodiment, the array 117 of mating conductors 118 is electrically parallel to a plurality of open-ended conductors (described below) between different nodal regions. The compensation regions 158 and 160 may extend approximately between nodal regions 170 and 172. More specifically, the compensation region 158 includes portions of the mating conductors 118 that extend from the nodal region 170 as indicated in FIG. 6 to the nodal region 172. The compensation region 160 includes portions of the mating conductors 118 that extend from the nodal region 170 to the contact pads 144; the conductive pathways (e.g., traces) of the compensation component 140; and portions of the circuit contacts 138 that extend to the nodal region 172 from contact pads 148 of the compensation component 140. The nodal regions 170 and 172 are regions where the parallel compensation regions 158 and 160 branch or intersect. For example, the nodal region 170 is located approximately where the plug contacts 146 engage the mating interfaces 120 and the nodal region 172 is located approximately where the mating conductors 118 electrically connect to the circuit contacts 138. However, the nodal regions may be different than those described herein. For example, the mating conductors 118 may be directly inserted into the conductor vias 139 such that the nodal region 172 is within the printed circuit 132.

For purposes of analysis, the average crosstalk along different stages may be represented by a vector or vectors whose magnitude and phase is measured at the midpoint of a corresponding stage. This does not apply to the initial offending crosstalk generated at a first stage proximate the mating interface 120, which is represented by a vector whose phase is zero.

FIG. 6 also shows vectors that represent crosstalk coupling between conductive pathways for certain regions in the connector 100 (FIG. 1). As shown, vector $A_0$ represents the offending crosstalk that occurs at the mating interfaces 120 between corresponding plug contacts 146 and mating conductors 118. Vectors $B_0$ and $C_0$ represent crosstalk (NEXT loss) in stages occurring proximate the mating interfaces 120. The NEXT stages represented by vectors $B_0$ and $C_0$ are not a compensation stage(s) since the plug contacts 146 and mating conductors 118 generate offending crosstalk. Vector $B_0$ represents crosstalk occurring between portions of the mating conductors 118 that extend between the mating interfaces 120 and the transition region 135. Vector $C_0$ represents crosstalk occurring between portions of the mating conductors 118 that extend between the mating interfaces 120 and the contact pads 144. Vector $B_{01}$ represents crosstalk occurring between the mating conductors 118 at the transition region 135. Because the crosstalk coupling in the transition region 135 changes polarity and has a positive polarity crosstalk magnitude that is approximately equal to a negative polarity crosstalk magnitude, the crosstalk effectively cancels itself out. Vector $C_{01}$ represents an open-ended crosstalk transition region where the polarity of the crosstalk coupling can be either positive or negative or both depending upon the polarity of the conductors that are capacitively coupled. Vector $B_1$ represents crosstalk occurring between portions of the mating conductors 118 that extend between the transition region 135 and the circuit contacts 138. Vector $C_1$ represents crosstalk coupling occurring along the circuit contacts 138 near the compensation component 140 proximate the loading end 106 (FIG. 1). Vector $A_1$ represents crosstalk along the circuit contacts 138 proximate the printed circuit 132 and may also include any other compensation crosstalk that occurs within the printed circuit 132.

In the exemplary embodiment, NEXT compensation for the offending crosstalk (NEXT loss) generated at the mating interface 120 is only provided by the compensation regions 158 and 160. In such embodiments, the printed circuit 132 may provide a negligible amount of NEXT compensation. However, in alternative embodiments, NEXT compensation may be generated with the printed circuit 132 as well.

Figure 7:
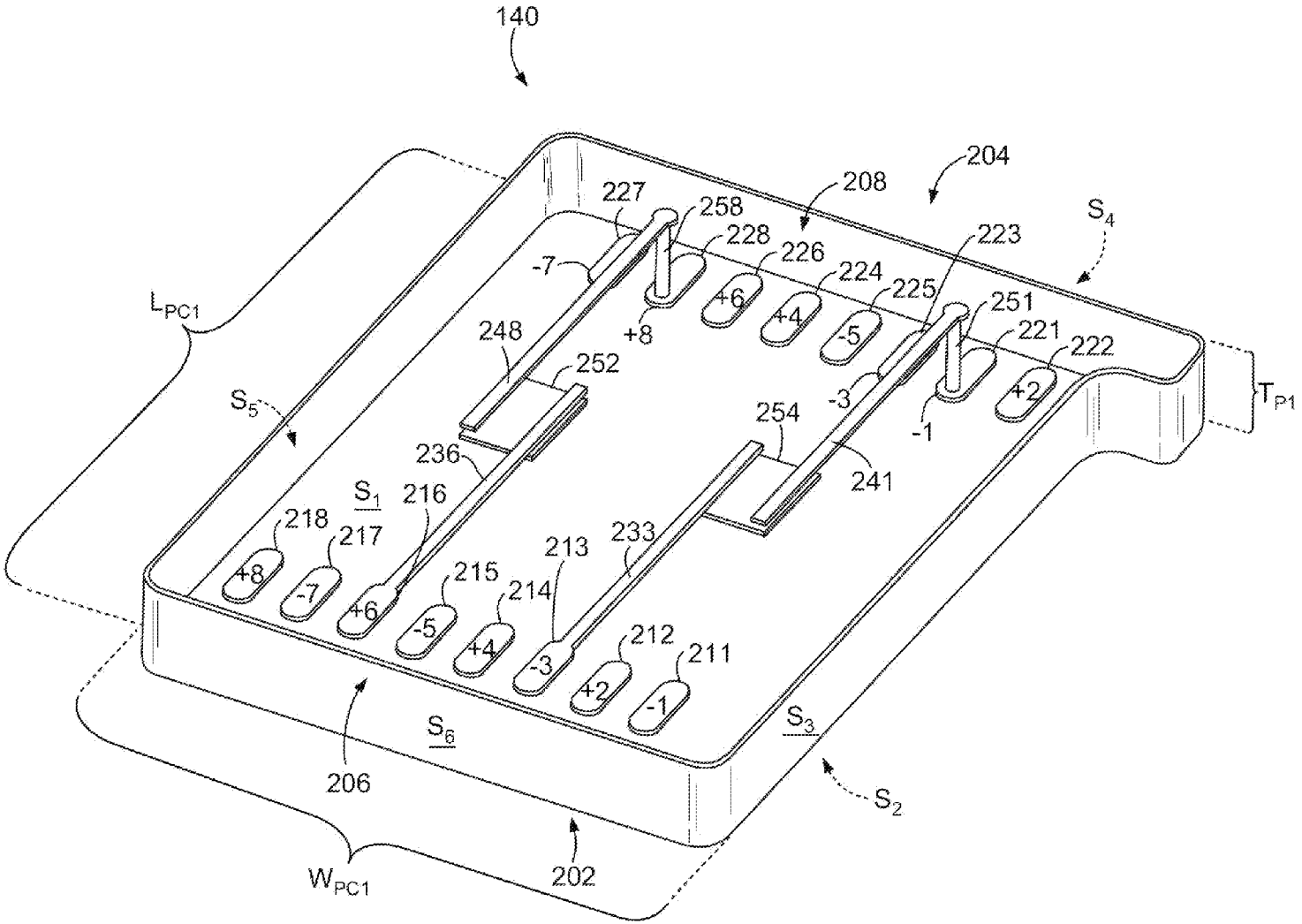
FIG. 7 is a top-perspective view of a compensation component that may be used with the connector shown in FIG. 1.

FIG. 7 is a perspective view of one exemplary embodiment of the compensation component 140 that may facilitate providing the compensation region 160 (FIG. 6). The compensation component 140 may be formed from a dielectric material and may be substantially rectangular and have a length $L_{PC1}$, a width $W_{PC1}$, and a substantially constant thickness $T_{PC1}$. Alternatively, the compensation component 140 may be other shapes. The compensation component 140 may be a circuit board formed from multiple layers of the dielectric material. The compensation component 140 includes a plurality of outer surfaces $S_1$-$S_6$, including a top surface $S_1$ that is configured to face the array 117 (FIG. 1), a bottom surface $S_2$, and side surfaces $S_3$-$S_6$ that extend along the thickness $T_{PC1}$ of the compensation component 140. The top and bottom surfaces $S_1$ and $S_2$, respectively, are on opposite sides of the compensation component 140 and are separated by the thickness $T_{PC1}$. Opposing side surfaces $S_4$ and $S_6$ are separated by the length $L_{PC1}$, and opposing side surfaces $S_3$ and $S_5$ are separated by the width $W_{PC1}$. Also shown, the compensation component 140 has an end portion 202 and an opposite end portion 204 that are separated from each other by the length $L_{PC1}$. When the connector 100 (FIG. 1) is fully assembled, the end portion 202 is proximate the mating end 104 (FIG. 1) and the end portion 204 is proximate the loading end 106 (FIG. 1).

The compensation component 140 may include first and second contact regions 206 and 208 that may be located proximate to the end portions 202 and 204, respectively. The contact regions 206 and 208 are configured to electrically connect the compensation component 140 to the mating conductors 118 (FIG. 1). The contact regions 206 and 208 may be directly engaged with the mating conductors 118 or may be electrically coupled through intervening components (e.g., the circuit contacts 138). By way of example, the surface $S_1$ may include a plurality of contact pads 211-218 that are configured to electrically connect with the mating conductors 118. More specifically, each contact pad 211-218 electrically connects with, respectively, the mating conductors 1-8 of differential pairs P1-P4 as shown in FIG. 3. Likewise, the surface $S_2$ may include a plurality of contact pads 221-228 that are configured to electrically connect with the circuit contacts 138. The contact pads 221-228 are arranged along the surface $S_2$ so that the circuit contacts 138 electrically couple the contact pads 221-228 to select mating conductors 118. More specifically, the contact pads 221-228 are arranged to correspond to the arrangement of the mating conductors 118 at the nodal region 172 (FIG. 6). For example, the contact pad 221 is electrically coupled to the mating conductor −1; the contact pad 222 is electrically coupled to the mating conductor +2; the contact pad 223 is electrically coupled to the mating conductor −3; the contact pad 224 is electrically coupled to the mating conductor +4; the contact pad 225 is electrically coupled to the mating conductor −5; the contact pad 226 is electrically coupled to the mating conductor +6; the contact pad 227 is electrically coupled to the mating conductor −7; the contact pad 228 is electrically coupled to the mating conductor +8.

Open-ended conductors of the compensation component 140 are configured to capacitively couple select mating conductors 118. An "open-ended conductor," as used herein, includes electrical components or conductive paths that do not carry a broadband frequency signal current (or only a high frequency signal current) when the connector 100 is operational. In the illustrated embodiment shown in FIG. 7, the open-ended conductors are open-ended traces 233, 236, 241, and 248. The open-ended traces 236 and 248 are capacitively coupled to one another through a non-ohmic plate 252, and the open-ended traces 233 and 241 are capacitively coupled to one another through a non-ohmic plate 254. As used herein, the term "non-ohmic plate" refers to a conductive plate that is not directly connected to any conductive material, such as traces or ground. When in use, the non-ohmic plate 252 may electromagnetically couple to, i.e., magnetically and/or capacitively couple to, the open-ended traces 236 and 248 thereby capacitively coupling the open-ended traces 236 and 248. The non-ohmic plate 254 may capacitively couple the open-ended traces 233 and 241. In alternative embodiments, the compensation component 140 does not use non-ohmic plates to facilitate capacitively coupling the open-ended traces.

Also shown, the open-ended traces 233 and 236 extend from the contact pads 213 and 216, respectively, toward the end portion 204. The open-ended traces 248 and 241 are electrically coupled to the contact pads 228 and 221, respectively, through vias 258 and 251, respectively. Accordingly, in the illustrated embodiment shown in FIG. 7, the mating conductors −3 and −1 may be capacitively coupled to one another through the compensation component 140, and the mating conductors +6 and +8 may be capacitively coupled to one another through the compensation component 140.

The non-ohmic plates 252 and 254 may be "free-floating," i.e., the plates do not contact either of the adjacent open-ended traces or any other conductive material that leads to one of the conductors 118 or ground. As shown, the compensation component 140 may have multiple layers where the non-ohmic plate and the corresponding open-ended traces are on separate layers. Furthermore, in the illustrated embodiment, the non-ohmic plates 252 and 254 are substantially rectangular; however, other embodiments may have a variety of geometric shapes. In the illustrated embodiment, the non-ohmic plates 252 and 254 are embedded within the compensation component 140 a distance from the corresponding open-ended traces to provide broadside coupling with the open-ended traces. Alternatively, the non-ohmic plates may be co-planer (e.g., on the corresponding surface) with respect to the adjacent traces and positioned therebetween such that each trace electromagnetically couples with an edge of the non-ohmic plate. In another alternative embodiment, each of the non-ohmic plate and open-ended traces may all be on separate layers of the compensation component 140.

In alternative embodiments, the open-ended conductors may be any electrical component capable of capacitive coupling with another electrical component. For example, the open-ended conductors may be plated thru-holes or vias, inter-digital fingers, and the like. Furthermore, in alternative embodiments, the compensation component 140 may include contact traces that carry a signal current between the end portions 202 and 204. Such contact traces are described in greater detail in in U.S. Pat. No. 7,914,345 (published as U.S. Patent Application Publication No. 2010/0041278), filed on Aug. 13, 2008 and entitled "ELECTRICAL CONNECTOR WITH IMPROVED COMPENSATION," which is incorporated by reference in the entirety. In addition, other embodiments may also include non-ohmic plates that capacitively couple mating conductors of different differential pairs proximate to one end of a circuit board. Such embodiments are described in U.S. patent application Ser. No. 12/109,544 (issued as U.S. Pat. No. 7,658,651), filed Apr. 25, 2008 and entitled "ELECTRICAL CONNECTORS AND CIRCUIT BOARDS HAVING NON-OHMIC PLATES," which is also incorporated by reference in the entirety.

Figure 8:
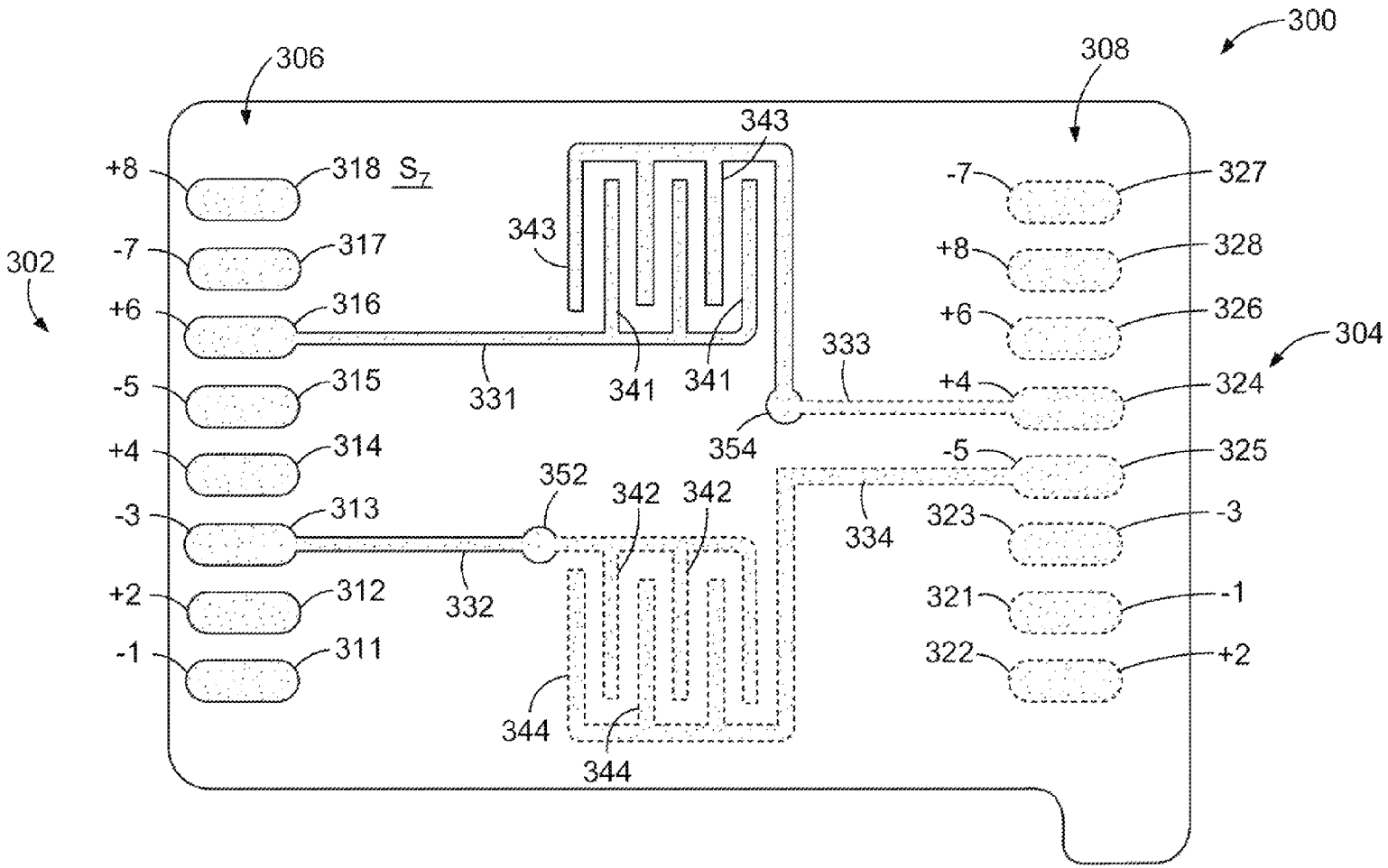
FIG. 8 is a plan view of a compensation component formed in accordance with another embodiment that may be use with the connector shown in FIG. 1.

FIG. 8 is a plan view of a top surface $S_7$ of an alternate compensation component 300 formed in accordance with another embodiment. The compensation component 300 may facilitate forming a compensation region similar to the compensation region 160 (FIG. 6). The compensation component 300 may have a similar size and shape as the compensation component 140 (FIG. 7) and may include first and second contact regions 306 and 308 that may be located proximate to end portions 302 and 304, respectively. The contact regions 306 and 308 are configured to electrically connect the compensation component 300 to corresponding mating conductors of an electrical connector, such as the connector 100 (FIG. 1). The contact regions 306 and 308 may be directly engaged with the mating conductors or may be electrically coupled through intervening components (e.g., circuit contacts).

By way of example, the surface $S_7$ may include a plurality of contact pads 311-318 in contact region 306 that are each configured to electrically connect with a corresponding one of the mating conductors. More specifically, each contact pad 311-318 electrically connects with, respectively, the mating conductors 1-8 of differential pairs P1-P4 as shown in FIG. 3. Likewise, a bottom surface may include a plurality of contact pads 321-328 (indicated by different shading) that are configured to electrically connect with the mating conductors 1-8 as indicated. The contact pads 321-328 are arranged along the bottom surface similar to the contact pads 221-228 (FIG. 7) so that the circuit contacts (not shown) electrically couple the contact pads 321-328 to select mating conductors 1-8. However, in other embodiments, the number of contact pads along the bottom surface or the top surface $S_7$ may be less than the number of mating conductors since not all mating conductors are electrically coupled to both ends of the compensation component 300.

Also shown, the compensation component 300 may include open-ended conductors 331 and 332 that extend from the contact region 306 and toward the contact region 308, and open-ended conductors 333 and 334 that extend from the contact region 308 and toward the contact region 306. The open-ended conductor 331 is electrically connected with the contact pad 316 that, in turn, is electrically connected with the mating conductor +6. The open-ended conductor 332 is electrically connected with the contact pad 313 that, in turn, is electrically connected with the mating conductor −3. Also, the open-ended conductor 333 is electrically connected with the contact pad 324 that, in turn, is electrically connected with the mating conductor +4. The open-ended conductor 334 is electrically connected with the contact pad 325 that, in turn, is electrically connected with the mating conductor −5.

Furthermore, as shown in FIG. 8, the open-ended conductor 332 includes a plated thru-hole or via 352 that transitions the open-ended conductor 332 through at least a portion of the thickness of the compensation component 300. In the illustrated embodiment, the open-ended conductor 332 is transitioned from the top surface $S_7$ to a bottom surface (not enumerated) where the contact pads 321-328 are located. Likewise, the open-ended conductor 333 includes a plated thru-hole or via 354 that also transitions the open-ended conductor 333 through at least a portion of the thickness of the compensation component 300. Specifically, the open-ended conductor 333 is transitioned from the bottom surface to the top surface $S_7$ where the contact pads 311-318 are located.

Also shown in FIG. 8, the open-ended conductors 331-334 may include corresponding inter-digital fingers 341-344, respectively. The inter-digital fingers 341-344 may capacitively couple with one another in the compensation component 300 to provide the compensation region. More specifically, the inter-digital fingers 341 are capacitively coupled to the inter-digital fingers 343 along the top surface $S_7$, and the inter-digital fingers 342 are capacitively coupled to the inter-digital fingers 344 along the bottom surface.

Figure 9:
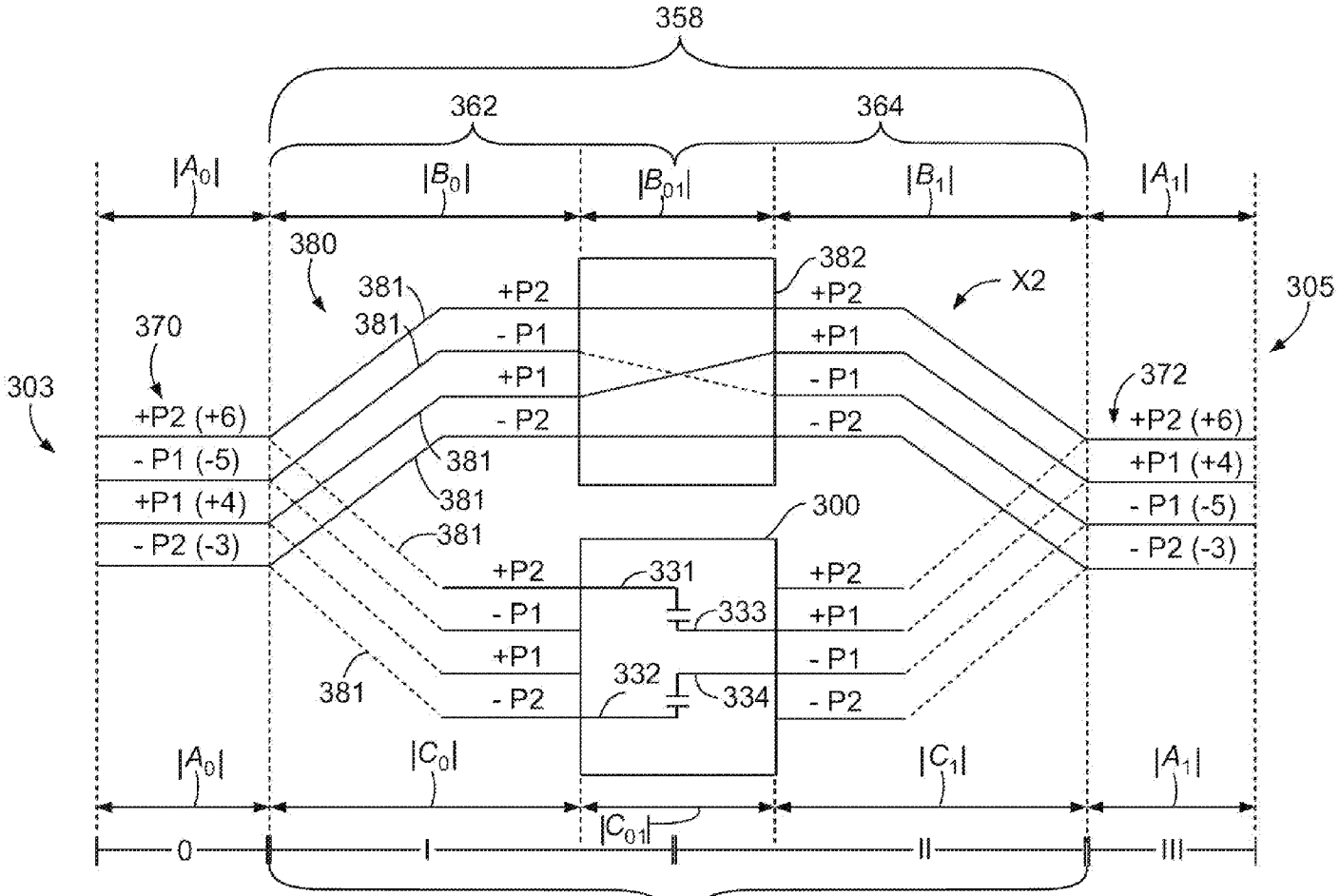
FIG. 9 illustrates an electrical schematic for the compensation component in accordance with one embodiment.

FIG. 9 is an electrical schematic of a connector that includes the compensation component 300 and may include similar features as the connector 100 described above. The connector may have first and second compensation regions 358 and 360 that are parallel to each other. The first compensation region 358 may include an interconnection path X2 where signal current flows through an array 380 of mating conductors 381 between nodal regions 370 and 372. The array 380 may form differential pairs P1 and P2 of mating conductors 381. (Although not shown, the array 380 may also form other differential pairs, such as differential pairs P3 and P4 shown in FIG. 3.) The differential pair P1 may include mating conductors +4 and −5, and the differential pair P2 may include mating conductors +6 and −3. The mating conductors +6 and −3 are split by the mating conductors +4 and −5 along the interconnection path X2. Proximate to the mating end, the mating conductor +4 extends along the mating conductor −3, and the mating conductor −5 extends along the mating conductors +6. Also shown, the interconnection path X2 may include a transition region 382 where the mating conductors 3-6 are rearranged.

The second compensation region 360 may include the open-ended conductors 331-334. As shown, the open-ended conductor 331 is electrically coupled to the mating conductor +6 proximate a mating end 303 and is capacitively coupled to the open-ended conductor 333. The open-ended conductor 333 is electrically coupled to the mating conductor +4 proximate to a loading end 305. As such, the open-ended conductors 331 and 333 may capacitively couple two mating conductors +6 and +4 of two differential pairs having a same sign of polarity. Also shown, the open-ended conductor 332 is electrically coupled to the mating conductor −3 proximate the mating end 303 and is capacitively coupled to the open-ended conductor 334. The open-ended conductor 334 is electrically coupled to the mating conductor −5 proximate the loading end 305. As such, the open-ended conductors 332 and 334 may capacitively couple two mating conductors −5 and −3 of two differential pairs having a same sign of polarity.

Figure 10:
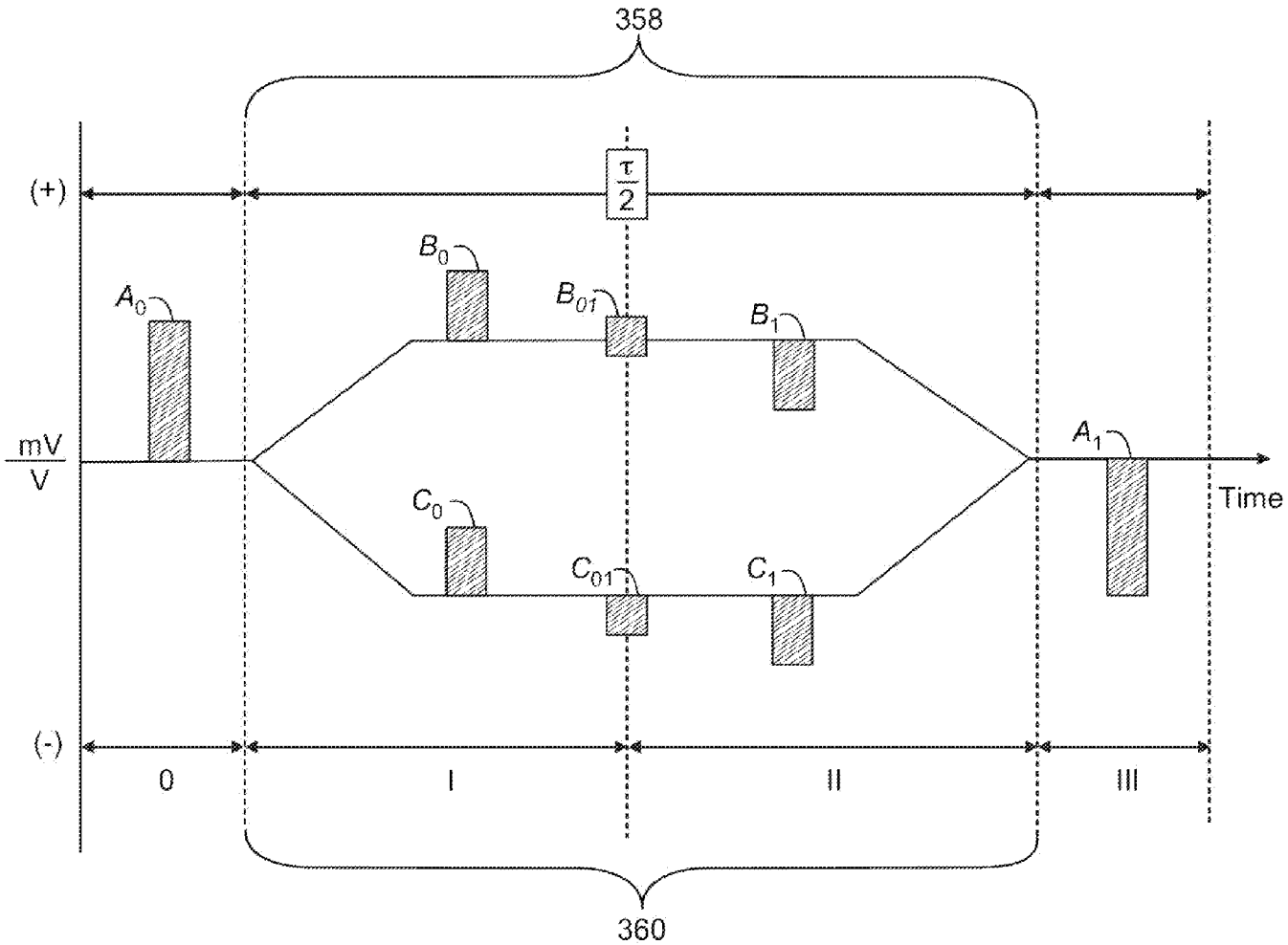
FIG. 10 illustrates polarity and magnitude as a function of transmission time delay for the embodiment shown in FIG. 7.

Also shown in FIG. 9 and FIG. 10, the electrical schematic may have four stages 0-III of crosstalk coupling. Stage 0 includes the offending crosstalk that may be generated where a connector engages a modular plug and is represented by a vector $A_0$, which has a positive polarity. Stage 0 may be located proximate to a nodal region 370. Stage I is a first NEXT stage where the mating conductors 381 have a polarity that is unchanged from the arrangement of the mating conductors 381 at Stage 0. As such, Stage I does not result in compensating crosstalk since Stage I continues to generate offending crosstalk (i.e., Stage I is a NEXT loss stage). The magnitude of the crosstalk in Stages 0 and I may vary because Stage I is a parallel NEXT stage. Stage I is represented by vectors $B_0$ and $C_0$, where vector $B_0$ is added in parallel to vector $C_0$ or $(B_0 \| C_0)$. Stage II is represented by vectors $B_1$ and $C_1$, where vector $B_1$ is added in parallel with vector $C_1$ or $(B_1 \| C_1)$. Stage II is a second NEXT stage where the mating conductors 381 have an arrangement with respect to each other that is different than the arrangement in Stage I. Specifically, the mating conductors +4 and −5 are crossed over one another at the transition region 382. During Stage II, the mating conductor +4 extends along the mating conductor +6, and the mating conductor −5 extends along the mating conductors −3. Accordingly, the crosstalk coupling of Stages I and II have opposite polarity. Furthermore, Stage III includes crosstalk generated by, for example, circuit contacts and/or a printed circuit proximate the loading end 305. Stage III may be located proximate to a nodal region 372. As such, Stages II and III generate compensating crosstalk coupling.

Also shown, the transition region 382 may include a sub-stage $B_{01}$ where the array 380 transitions from Stage I to Stage II. Because the crosstalk coupling in the transition region 382 changes polarity, the crosstalk of the transition region 382 effectively cancels itself out. However, the compensation region 360 may include a sub-stage $C_{01}$, which represents an open-ended crosstalk transition region where the polarity of the crosstalk coupling can be either positive or negative or both depending upon the polarity of the conductors that are capacitively coupled. The sub-stages $B_{01}$ and $C_{01}$ may occur at an equal time delay. Vector $B_{01}$ is added in parallel with vector $C_{01}$ or $(B_{01} \| C_{01})$.

Additionally, different mating conductors 381 extending from the mating end and mating conductors 381 extending from the loading end may be capacitively coupled to each other through the component 300. Although FIG. 9 illustrates the mating conductors +4 and +6 and the mating conductors −3 and −5 being capacitively coupled with each other, in alternative embodiments, any mating conductor can be capacitively coupled to another mating conductor (or itself) in order to obtain a desired electrical performance. In particular embodiments, the mating conductors 381 that are capacitively coupled to one another in the compensation component 300 are configured to account for or effectively cancel any remaining crosstalk in the connector.

FIG. 10 graphically illustrates polarity and magnitude as a function of transmission time delay for the connector having the electrical schematic shown in FIG. 9. Because that crosstalk vectors $\{B_0, B_{01}, B_1\}$ are electrically parallel to $\{C_0, C_{01}, C_1\}$, the time delay measured at vectors $B_0$ and $C_0$ are substantially similar, the time delay measured at vectors $B_{01}$ and $C_{01}$ are substantially similar, and the time delay measured at vectors $B_1$ and $C_1$ are substantially similar.

Figure 11A:
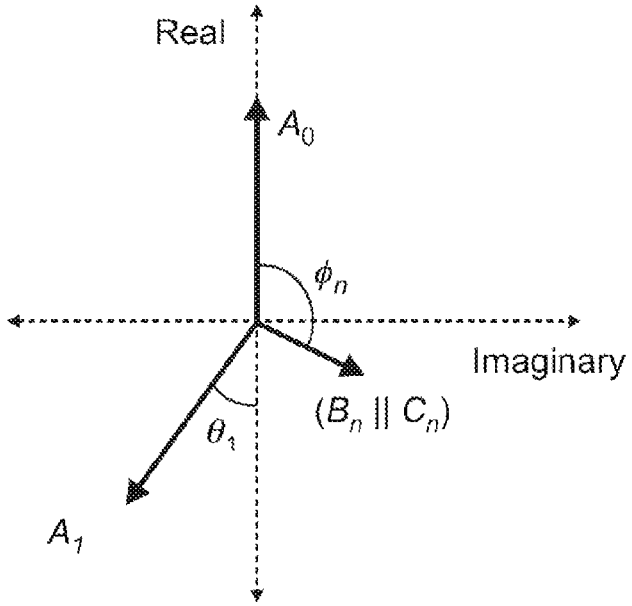
FIGS. 11A-11C illustrate vector addition for electrical connectors formed in accordance with the present invention.
Figure 11B:
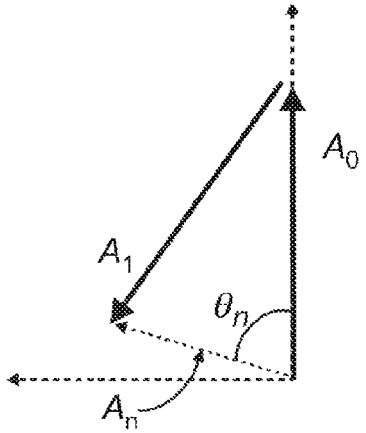
Figure 11C:
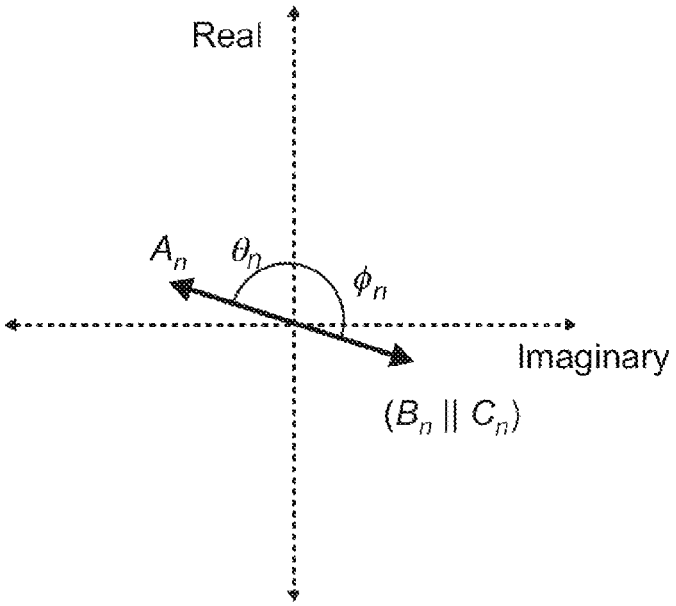

FIGS. 11A-11C are graphs illustrating the complex vectors associated with the first and second compensation regions 358 and 360. Each complex vector represents a different stage and may have a magnitude component and a phase component.

As discussed above, in order to cancel or minimize the NEXT loss, a connector may be configured such that the summation of the vectors, a resultant vector $A_N$, representing the crosstalk coupling regions of the connector should be approximately equal to zero. FIG. 11A is a complex polar representation of the crosstalk vectors defined in FIGS. 9 and 10 where each may have a defined magnitude and phase. Vector $A_0$ is the offending NEXT loss generated at stage 0 at nodal region 370 (FIG. 9). Vector $A_0$ has a magnitude $|A_0|$ that is positive in polarity and has zero phase delay. For analysis purposes, the crosstalk vector $A_0$ has a zero phase delay and is not rotated in phase relative to the real axis. The phase for $A_0$ may be considered a reference phase for which all subsequent crosstalk vector phases are measured. Vector $A_1$ has a negative magnitude $|A_1|$ due to the switch in polarity coupling. Also, vector $A_1$ is rotated in phase by $\theta_1$ relative to the real axis or relative to the reference phase of vector $A_0$.

For purposes of analysis, a resultant vector $A_N$ (i.e., the summation of vectors $A_0$ and $A_1$), which is shown in FIG. 11B, may be thought of as the crosstalk that is generated by a conventional connector system that those skilled in the art may desire to compensate. Even though vector $A_1$ may have a magnitude equal to and a polarity opposite that of vector $A_0$, the vector $A_1$ measures a phase delay relative to vector $A_0$ when the two vectors are summed together, thus the resultant vector $A_N$ may have a magnitude that is significantly larger than zero. Accordingly, an additional crosstalk vector may be needed to cancel out the NEXT loss of vector $A_N$. To this end, the parallel compensation regions 358 and 360 may be configured to compensate for the resultant crosstalk represented by $A_N$. A vector $(B_N \| C_N)$ represents the resultant vector when all parallel NEXT crosstalk compensation vectors are added together (i.e., $(B_0 \| C_0)$, $(B_1 \| C_1)$, and $(B_{01} \| C_{01})$). The vector $(B_N \| C_N)$ may be configured to have a polarity opposite that of $A_0$ and a phase shift $\phi_n$, which may be 90° plus additional phase delay relative to the vector $A_0$. As shown in FIG. 11C, the parallel compensation regions 358 and 360 may be configured so that the vector $(B_N \| C_N)$ effectively cancels out the vector $A_N$. Accordingly, when the vector $A_N$ is added to $(B_N \| C_N)$, the resultant vector is desired to be approximately zero.

Thus, unlike prior art/techniques having multiple stages of compensation along a single interconnection path, the electrical connector 100 may provide multiple parallel compensation regions where all compensation regions are not time delayed with respect to each other. However, the compensation component 300 may be reconfigured and, more particular, the vector $(B_N \| C_N)$ may be configured to achieve a desired electrical performance.

Figure 12:
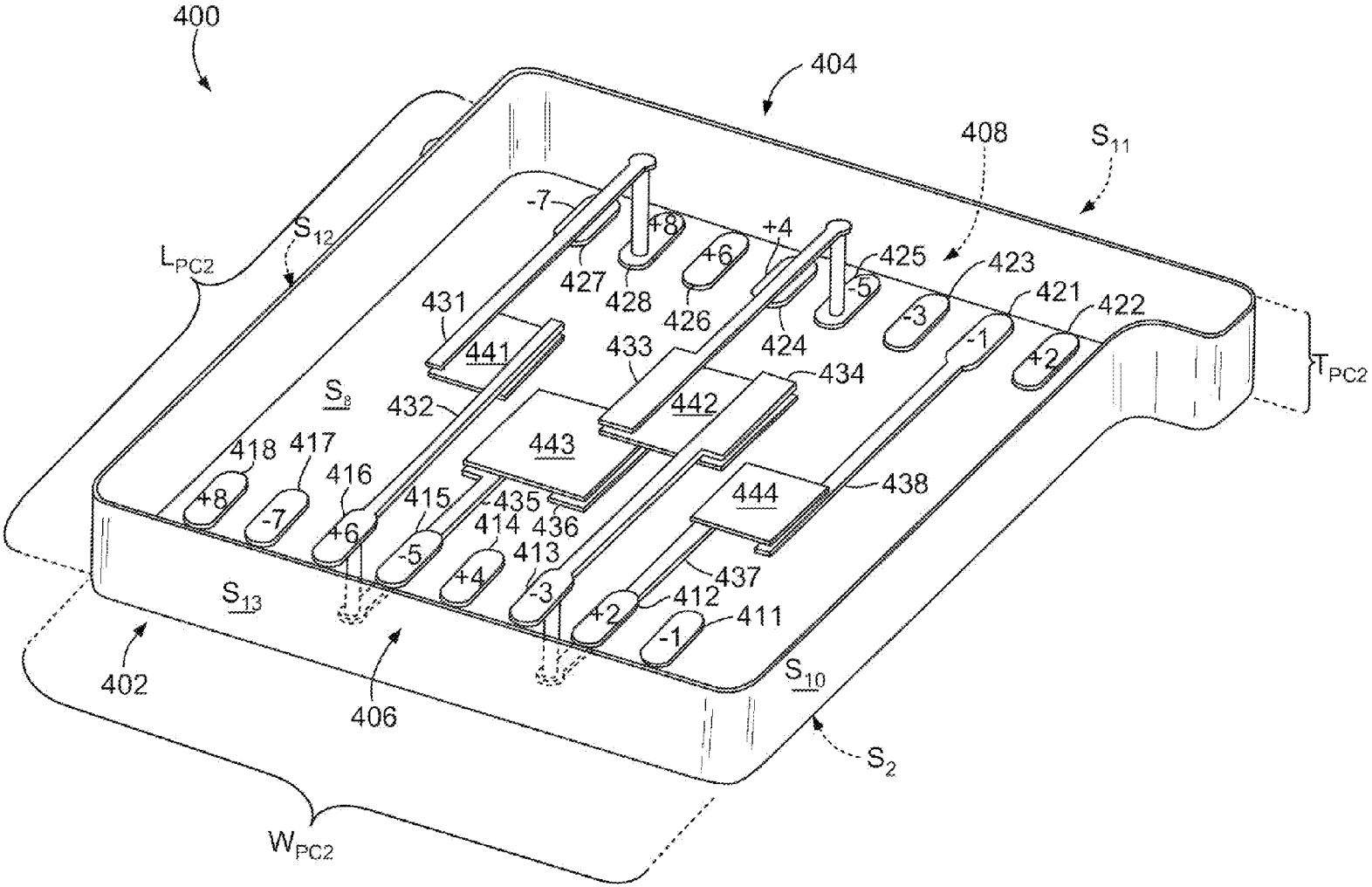
FIG. 12 is a top-perspective view of another compensation component that may be used with the connector shown in FIG. 1.
Figure 13:
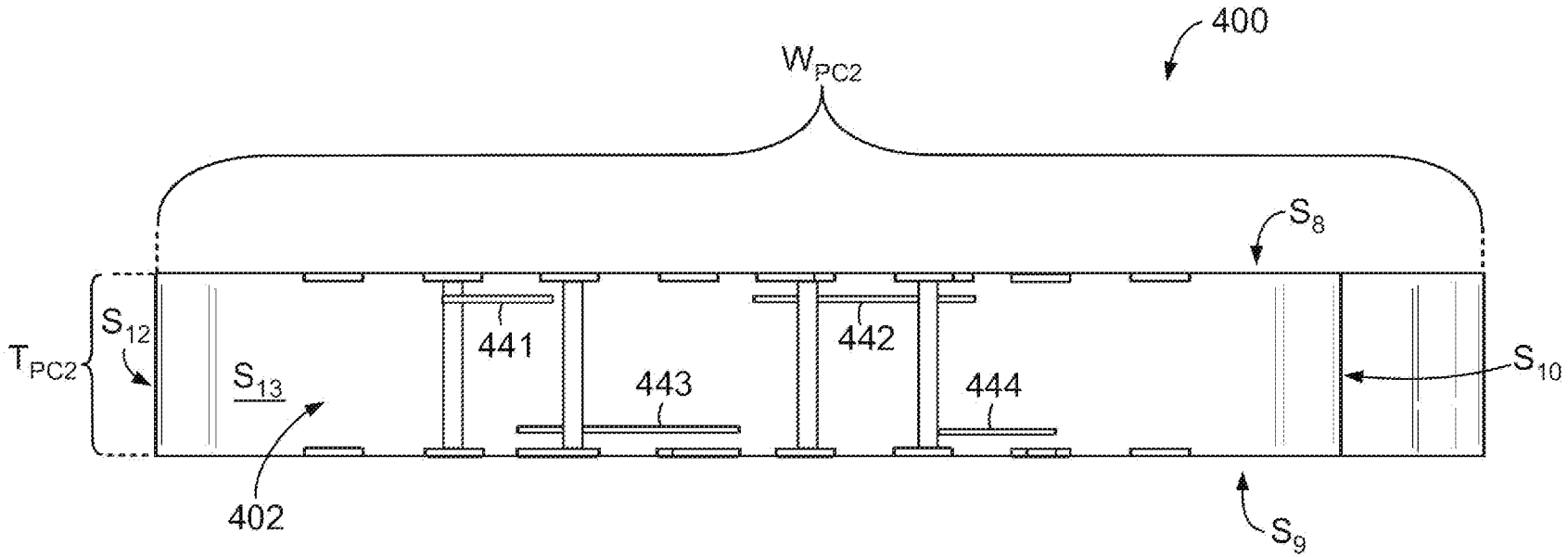
FIG. 13 is a front view of the compensation component shown in FIG. 12.

FIGS. 12 and 13 are a top-perspective view and a front view, respectively, of a compensation component 400 that may be used with an electrical connector, such as the connector 100 shown in FIG. 1. The compensation component 400 may have similar features and shapes as the compensation component 140 (FIG. 7). Specifically, the compensation component 400 may comprise a dielectric material that is sized and shaped similar to the compensation component 140. As shown, the compensation component 400 may be substantially rectangular and have a length $L_{PC2}$ (FIG. 11), a width $W_{PC2}$, and a substantially constant thickness $T_{PC2}$. Alternatively, the compensation component 400 may be other shapes. The compensation component 400 may be a printed circuit (e.g., circuit board or flex circuit) having multiple layers of dielectric material. As shown, the compensation component 400 has a plurality of outer surfaces $S_8$-$S_{13}$, including a top surface $S_8$, a bottom surface $S_9$, and side surfaces $S_{10}$-$S_{13}$ (surface $S_{11}$ is shown in FIG. 12). The top and bottom surfaces $S_8$ and $S_9$, respectively, are on opposite sides of the compensation component 400 and are separated by the thickness $T_{PC2}$. Also shown, the compensation component 400 has an end portion 402 and an opposite end portion 404 (FIG. 12) that are separated from each other by substantially the length $L_{PC2}$.

With respect to FIG. 12, the compensation component 400 may include first and second contact regions 406 and 408 that may be located proximate to the end portions 402 and 404, respectively. The contact regions 406 and 408 are configured to electrically connect the compensation component 400 to mating conductors (not shown). The contact regions 406 and 408 may be directly engaged with the mating conductors or may be electrically coupled through intervening components. Similar to the compensation component 140, the surface $S_8$ may include a plurality of contact pads 411-418 that are configured to electrically connect with the mating conductors. Each contact pad 411-418 electrically connects with, respectively, the mating conductors −1 to +8 of differential pairs P1-P4 (FIG. 3) as indicated on the corresponding contact pads. Likewise, the surface $S_9$ may include a plurality of contact pads 421-428 that are configured to electrically connect with the mating conductors −1 to +8 as indicated.

Figure 14:
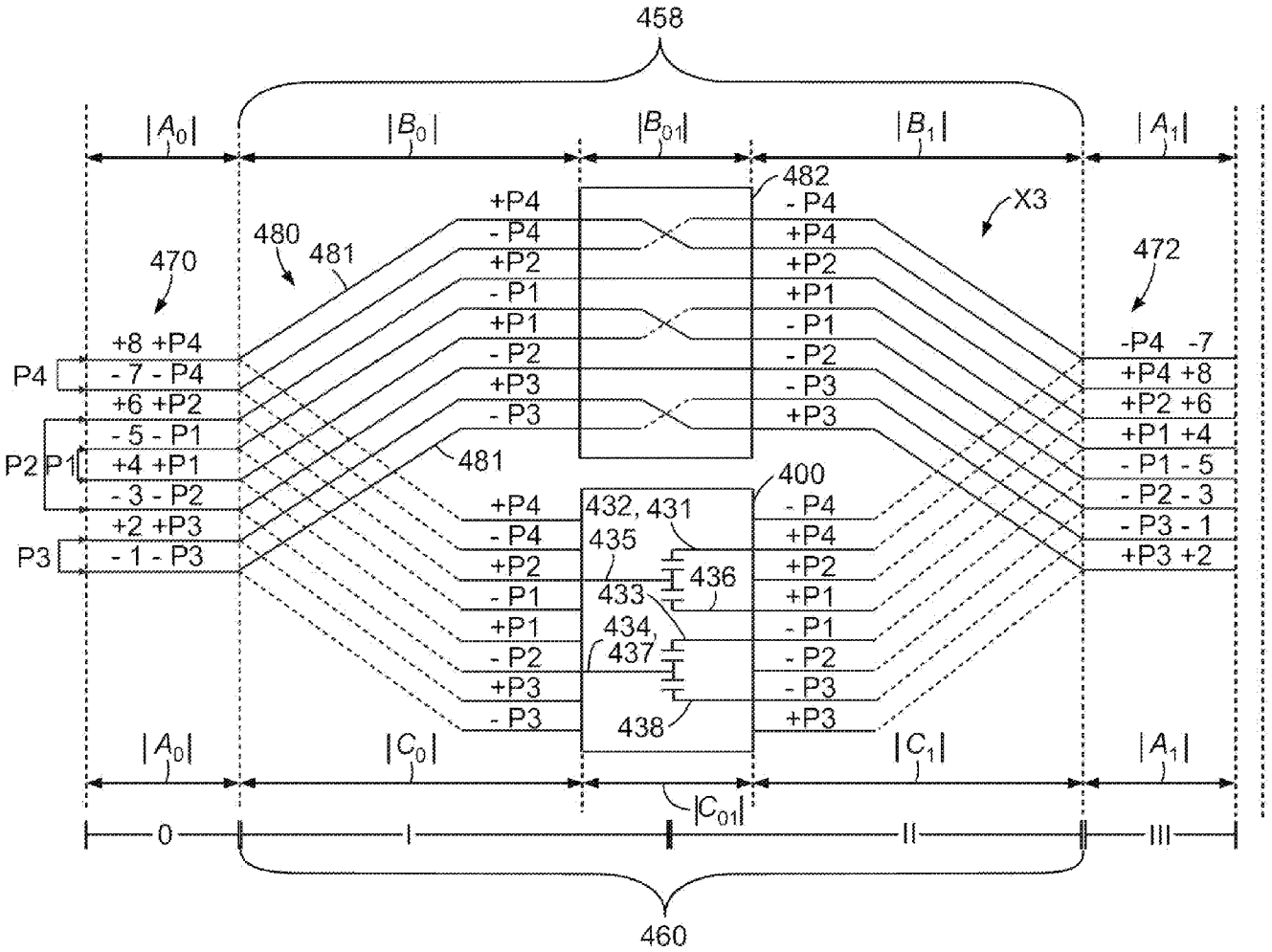
FIG. 14 illustrates an electrical schematic of an electrical connector that includes the compensation component of another embodiment.

The compensation component 400 capacitively couples selected mating conductors through open-end conductors. The open-ended conductors are illustrated as open-ended traces 431-438 that extend from corresponding contact pads along the surfaces $S_8$ and $S_9$. However, the compensation component 400 may include alternative or additional open-ended conductors for capacitively coupling the selected mating conductors. In the illustrated embodiment, the open-ended traces 431-438 interact with non-ohmic plates 441-444 to provide a compensation region 460 (FIG. 14). More specifically, the open-ended traces 431 (+8) and 432 (+6) extend from contact pads 428 and 416, respectively, toward the non-ohmic plate 441; the open-ended traces 433 (−5) and 434 (−3) extend from contact pads 425 and 413, respectively, toward the non-ohmic plate 442; the open-ended traces 435 (+6) and 436 (+4) extend from contact pads 416 and 424, respectively, toward the non-ohmic plate 443; and the open-ended traces 437 (−3) and 438 (−1) extend from contact pads 413 and 421, respectively, toward the non-ohmic plate 444. As shown, the open-ended traces 433-436 may have wider or broader portions that capacitively couple with the corresponding non-ohmic plates. Furthermore, the compensation component 400 may have non-ohmic plates 441-444 proximate to either of the top and bottom surfaces $S_8$ and $S_9$ as shown in FIG. 13.

Similar to the other described compensation components, the contact pads 421-428 may be arranged along the bottom surface similar to the contact pads so that the circuit contacts (not shown) electrically couple the contact pads 421-428 to select mating conductors 1-8. However, in other embodiments, the number of contact pads along the bottom surface or the top surface $S_9$ may be less than the number of mating conductors since not all mating conductors are electrically coupled to both ends of the compensation component 400.

FIG. 14 is an electrical schematic of a connector that includes the compensation component 400 and may include similar features as the connector 100 described above. The connector may have parallel first and second compensation regions 458 and 460. The first compensation region 458 may be formed by an interconnection path X3 where signal current flows through an array 480 of mating conductors 481 between nodal regions 470 and 472. The array 480 may form differential pairs P1-P4 of mating conductors 481. The differential pair P1 may include mating conductors +4 and −5, and the differential pair P2 may include mating conductors +6 and −3. The mating conductors +6 and −3 are split by the mating conductors +4 and −5 along the interconnection path X3. Also shown, the interconnection path X3 may include a transition region 482 where the mating conductors 1-8 are rearranged with respect to each other.

Furthermore, the second compensation region 460 may include the open-ended conductors 431-438. As shown, the open-ended conductors 432 and 435 extend parallel to each other in the compensation component 400 and are electrically coupled to the mating conductor +6. The open-ended conductors 432 and 435 are capacitively coupled to the open-ended conductors 431 and 436, respectively. The open-ended conductor 431 is electrically coupled to the mating conductor +8, and the open-ended conductor 436 is electrically coupled to the mating conductor +4. Accordingly, a mating conductor of one differential pair (i.e., P2) may be capacitively coupled to the mating conductors of two other differential pairs (i.e., P4 and P1). Moreover, the mating conductors that are capacitively coupled to one another may all be of the same polarity. However, in alternative embodiments the capacitively coupled mating conductors may be of opposing polarity.

Likewise, the open-ended conductors 434 and 437 extend parallel to one another and are electrically coupled to the mating conductor −3 and are capacitively coupled to the open-ended conductors 433 and 438, respectively. The open-ended conductor 433 is electrically coupled to the mating conductor −5, and the open-ended conductor 438 is electrically coupled to the mating conductor −1.

Similar to the electrical schematic shown in FIG. 9, the electrical schematic of FIG. 14 may have four stages 0-III of crosstalk coupling. Stage 0 includes the offending crosstalk that may be generated when a connector engages a modular plug and is represented by a vector $A_0$, which may have a positive polarity. Stage 0 may be located proximate to a nodal region 470. Stage I is a first NEXT stage where the mating conductors 481 have a polarity that is unchanged from the arrangement of the mating conductors 481 at Stage 0. Stage I is represented by vectors $B_0$ and $C_0$, where vector $B_0$ is added in parallel to vector $C_0$ or $(B_0 \| C_0)$. Stage II is represented by vectors $B_1$ and $C_1$, where vector $B_1$ is added in parallel with vector $C_1$ or $(B_1 \| C_1)$. Stage II is a second NEXT stage where the mating conductors 381 have an arrangement with respect to each other that is different than the arrangement in Stage I. Specifically, the mating conductors +4 and −5 are crossed over one another, the mating conductors +8 and −7 are crossed over one another, and the mating conductors −1 and +2 are crossed over one another at the transition region 382. However, the mating conductors +6 and −3 of the split differential pair P2 do not cross over one another or any other mating conductor. Each of the mating conductors 1-8 along the interconnection path X3 may be supported by a band of material (not shown) at the transition region 482.

During Stage II, the mating conductor +6 extends along and between the mating conductors +8 and +4, and the mating conductor −3 extends along and between the mating conductors −5 and −1. Accordingly, the crosstalk coupling of Stages I and II have opposite polarity. Furthermore, Stage includes crosstalk generated by, for example, circuit contacts or a printed circuit. Stage III may be located proximate to a nodal region 372.

Also shown, the transition region 482 may include a sub-stage $B_{01}$ where the array 480 transitions from Stage I to Stage II. Because the crosstalk coupling in the transition region 482 changes polarity, the crosstalk of the transition region 482 effectively cancels itself out. However, the compensation region 460 may include a sub-stage $C_{01}$, which represents an open-ended crosstalk transition region where the polarity of the crosstalk coupling can be either positive or negative or both depending upon the polarity of the conductors that are capacitively coupled. The sub-stages $B_{01}$ and $C_{01}$ may occur at an equal time delay. Vector $B_{01}$ is added in parallel with vector $C_{01}$ or ($B_{01}\|C_{01}$). Accordingly, different mating conductors 381 may be capacitively coupled to each other through the component 400 based upon a desired electrical performance.

Figure 15:
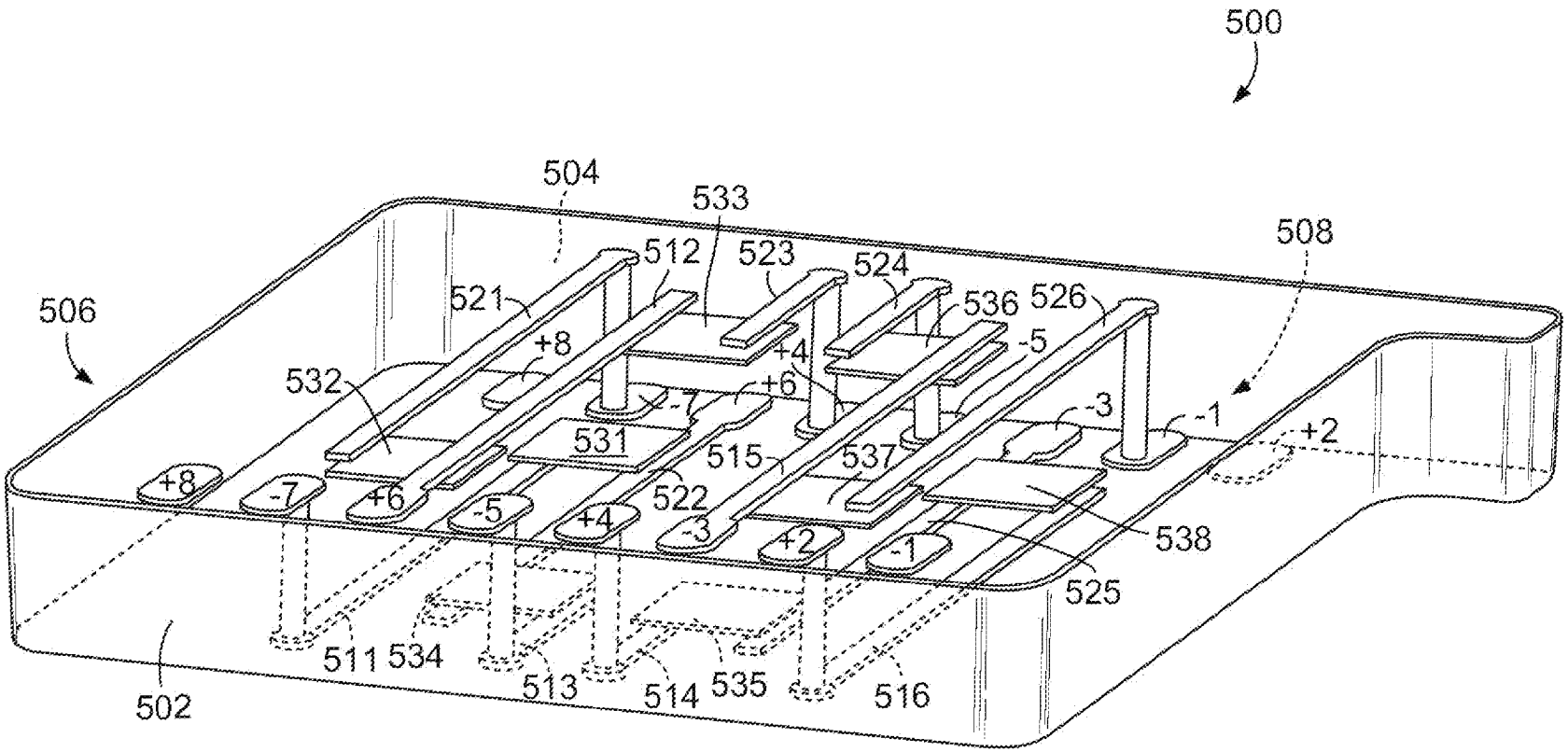
FIG. 15 is a top-perspective view of another compensation component that may be used with the connector shown in FIG. 1.

FIG. 15 is a top-perspective view of a compensation component 500 that may be used with an electrical connector, such as the connector 100 shown in FIG. 1. The compensation component 500 may facilitate forming a compensation region similar to the compensation region 160 (FIG. 6). The compensation component 500 may have a similar size and shape as the compensation component 140 (FIG. 7) and 300 (FIG. 8) and may include first and second contact regions 506 and 508 that may be located proximate to end portions 502 and 504, respectively. The contact regions 506 and 508 may be proximate to a mating end portion (not shown) and a terminating end portion (not shown), respectively, of a contact sub-assembly (not shown) similar to the contact sub-assembly 110 (FIG. 2). The contact regions 506 and 508 are configured to electrically connect the compensation component 500 to corresponding mating conductors of an electrical connector, such as the connector 100 (FIG. 1). The contact regions 506 and 508 may be directly engaged with the mating conductors or may be electrically coupled through intervening components (e.g., circuit contacts).

The compensation component 500 illustrates an exemplary embodiment where mating conductors 118 may capacitively couple to mating conductors other than mating conductors −3 and +6. Furthermore, the capacitive coupling may occur in regions that are not proximate to a middle of the compensation component 500. More specifically, the compensation component may include open-ended conductors 511, 512, 513, 514, 515, and 516 that are electrically connected to contact pads that are, in turn, electrically connected to mating conductors −7, +6, −5, +4, −3, and +2, respectively. The open-ended conductors 511-516 extend from the contact region 506 toward the contact region 508.

As shown, each open-ended conductor 511-516 capacitively couples to another open-ended conductor that extends from the contact region 508 and toward the contact region 506. More specifically, the open-ended conductors 521, 522, 523, 524, 525, and 526 are electrically connected to contact pads that are, in turn, electrically connected to the mating conductors −7, +6, +4, −5, −3, and −1, respectively. In the particular embodiment shown in FIG. 15, the open-ended conductor 511 capacitively couples to the open-ended conductor 522 through a non-ohmic plate 531 proximate to the contact region 508; the open-ended conductor 512 capacitively couples to the open-ended conductor 521 through a non-ohmic plate 532 proximate to the contact region 506 and also to the open-ended conductor 523 through a non-ohmic plate 533 proximate to the contact region 508; the open-ended conductor 513 capacitively couples to the open-ended conductor 522 through a non-ohmic plate 534 proximate to the contact region 506; the open-ended conductor 514 capacitively couples to the open-ended conductor 525 through a non-ohmic plate 535 proximate to the contact region 506; the open-ended conductor 515 capacitively couples to the open-ended conductor 524 through a non-ohmic plate 536 proximate to the contact region 508 and also to the open-ended conductor 526 through a non-ohmic plate 537 proximate to the contact region 506; the open-ended conductor 516 capacitively couples to the open-ended conductor 525 through a non-ohmic plate 538 proximate to the contact region 508.

Figure 16:
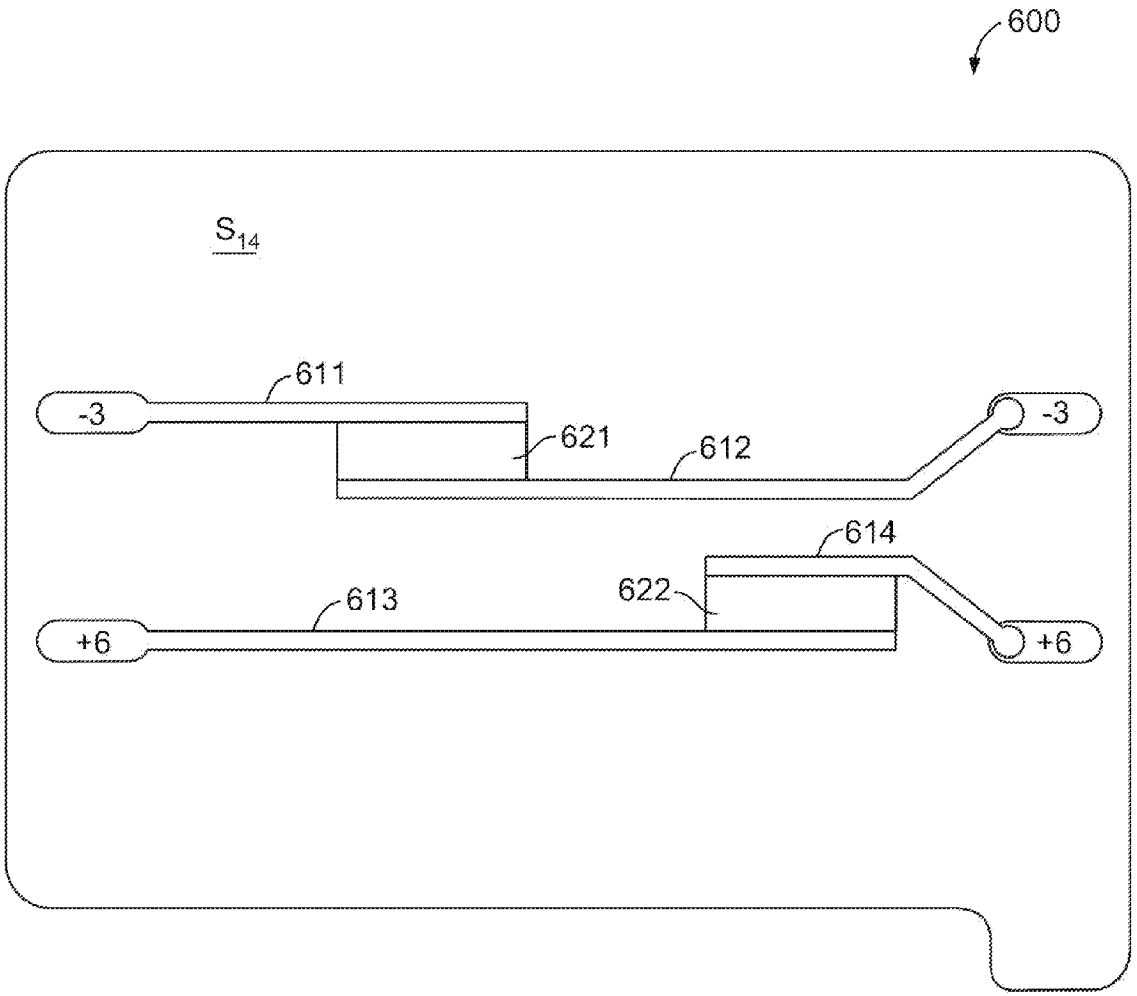
FIG. 16 is a plan view of another compensation component that may be used with the connector shown in FIG. 1.

FIG. 16 is a plan view of a top surface $S_{14}$ of a compensation component 600 formed in accordance with another embodiment. The compensation component 600 includes open-ended conductors 611-614 that capacitively couple to one another through a pair of non-ohmic plates 621 and 622. More specifically, the open-ended conductors 611 and 612 are electrically connected to respective contact pads that, in turn, are electrically connected to the mating conductor −3. The open-ended conductors 611 and 612 may then be capacitively coupled to one another through the non-ohmic plate 621. The open-ended conductors 613 and 614 are electrically connected to respective contact pads that, in turn, are electrically connected to the mating conductor +6. The open-ended conductors 613 and 614 may then be capacitively coupled to one another through the non-ohmic plate 622.

As such, FIG. 16 illustrates an exemplary embodiment in which the compensation component 600 includes first and second open-ended conductors (e.g., the open-ended conductors 611 and 612) that are electrically connected to a common mating conductor and also capacitively coupled to one another. Such embodiments may be desired in order to improve return loss.

Accordingly, various mating conductors may be capacitively coupled to one another through the compensation components described herein. The open-ended conductors in the compensation components may capacitively couple to one or more open-ended conductors in a middle or center region of the compensation component or proximate to one of the end portions. The open-ended conductors may capacitively couple different mating conductors of the same or different polarity, and the open-ended conductors may also capacitively couple the same mating conductor at opposite ends.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments.

For example, although the embodiments described above illustrate two parallel compensation regions (i.e., formed from one interconnection path and one compensation component), alternative embodiments include connectors that may have more than two parallel compensation regions. For instance, there may be one interconnection path comprising a plurality of mating conductors and two compensation components having respective open-ended conductors that capacitively couple the mating conductors of the interconnection path. The two compensation components and the interconnection path may be electrically parallel to one another. Also, one compensation component may have electrically parallel open-ended conductors that may capacitively couple to either the same mating conductor or different mating conductors.

When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector comprising:

a connector body configured to mate with a plug connector and a contact sub-assembly held by the connector body, the contact sub-assembly comprising:

a plurality of mating conductors that are configured to transmit signal current, wherein each of the mating conductors extends between an engagement portion and an interior portion of the respective mating conductor, the engagement portions of the mating conductors configured to engage plug contacts of a mating connector, the engagement portions being located proximate to one another at a first nodal region, the interior portions of the mating conductors being located proximate to one another at a second nodal region;

first open-ended conductors electrically connected to the engagement portions of corresponding mating conductors and extending from the first nodal region; and second open-ended conductors electrically connected to the interior portions of corresponding mating conductors and extending from the second nodal region, wherein the first open-ended conductors are capacitively coupled to the second open-ended conductors.

2. The electrical connector of claim 1, wherein the mating conductors form a first compensation region and the first and second open-ended conductors form a second compensation region, the first and second compensation regions being parallel to each other between the first and second nodal regions.

3. The electrical connector of claim 1, wherein at least one of the first open-ended conductors is electrically connected to a corresponding mating conductor and at least one of the second open-ended conductors is electrically connected to a different corresponding mating conductor, said at least one of the first open-ended conductors being capacitively coupled to said at least one of the second open-ended conductors.

4. The electrical connector of claim 1, wherein at least one of the first open-ended conductors and at least one of the second open-ended conductors is electrically connected to a common mating conductor, said at least one of the first open-ended conductors being capacitively coupled to said at least one of the second open-ended conductors.

5. The electrical connector of claim 1, further comprising a circuit board that includes the first and second open-ended conductors.

6. The electrical connector of claim 5, wherein the capacitively coupled first and second open-ended conductors include at least one of (a) inter-digital fingers and (b) open-ended traces capacitively coupled through non-ohmic plates.

7. The electrical connector of claim 1, wherein the mating conductors form first and second differential pairs, the first differential pair of mating conductors splitting the second differential pair of mating conductors.

8. The electrical connector of claim 7, wherein each mating conductor of the second differential pair is electrically coupled to one of the first or second open-ended conductors.

9. The electrical connector of claim 7, wherein the mating conductors form four differential pairs including the first and second differential pairs.

10. The electrical connector of claim 1, wherein the mating conductors are arranged to provide a near-end crosstalk (NEXT) compensation stage and the first and second open-ended conductors are arranged to provide a different NEXT compensation stage, the NEXT compensation stages being configured to generate compensating signals for substantially canceling or reducing a designated amount of offending crosstalk.

11. A contact sub-assembly comprising:

a plurality of mating conductors that are configured to transmit signal current, wherein each of the mating conductors extends between an engagement portion and an interior portion of the respective mating conductor, the engagement portions of the mating conductors configured to engage mating contacts, the engagement portions being located proximate to one another at a first nodal region, the interior portions of the mating conductors being located proximate to one another at a second nodal region;

first open-ended conductors electrically connected to the engagement portions of corresponding mating conductors and extending from the first nodal region; and second open-ended conductors electrically connected to the interior portions of corresponding mating conductors and extending from the second nodal region, wherein the first open-ended conductors are capacitively coupled to the second open-ended conductors.

12. The contact sub-assembly of claim 11, wherein the mating conductors form a first compensation region and the open-ended conductors form a second compensation region, the first and second compensation regions being parallel to each other between the first and second nodal regions.

13. The contact sub-assembly of claim 11, wherein at least one of the first open-ended conductors is electrically connected to a corresponding mating conductor and at least one of the second open-ended conductors is electrically connected to a different corresponding mating conductor, said at least one of the first open-ended conductors being capacitively coupled to said at least one of the second open-ended conductors.

14. The contact sub-assembly of claim 11, wherein at least one of the first open-ended conductors and at least one of the second open-ended conductors is electrically connected to a common mating conductor, said at least one of the first open-ended conductors being capacitively coupled to said at least one of the second open-ended conductors.

15. A contact sub-assembly comprising:

a plurality of differential pairs comprising mating conductors that are configured to transmit signal current along an interconnection path; and a plurality of open-ended conductors, each of the open-ended conductors being electrically connected to a corresponding mating conductor of the plurality of differential pairs, the open-ended conductors configured to capacitively couple select mating conductors thereby providing a compensation region that is electrically parallel to the interconnection path.

16. The contact sub-assembly of claim 15, wherein the plurality of differential pairs extend between a common first nodal region and a common second nodal region and the plurality of open-ended conductors extend between the common first nodal region and the common second nodal region.

17. The contact sub-assembly of claim 16, wherein each of the mating conductors extends between an engagement portion and an interior portion of the respective mating conductor, the engagement portions of the mating conductors being located in the common first nodal region and the interior portions of the mating conductors being located in the common second nodal region, the engagement portions configured to engage plug contacts.

18. The contact sub-assembly of claim 15, wherein the open-ended conductors include first and second open-ended conductors, the first open-ended conductor being electrically connected to a corresponding mating conductor of the plurality of mating conductors and the second open-ended conductor being electrically connected to a different corresponding mating conductor of the plurality of mating conductors, the first and second open-ended conductors being capacitively coupled to each other.

19. The contact sub-assembly of claim 15, wherein the open-ended conductors include first and second open-ended conductors that are electrically connected to a common mating conductor of the plurality of mating conductors, the first and second open-ended conductors being capacitively coupled to each other.

20. The contact sub-assembly of claim 15, further comprising a circuit board that includes the open-ended conductors.

* * * * *